US010821048B2

(12) United States Patent
Clausen et al.

(10) Patent No.: US 10,821,048 B2
(45) **Date of Patent: *Nov. 3, 2020**

(54) CRUTCH WITH ENERGY STORAGE AND ENERGY RETURN

(71) Applicant: Össur Iceland chf, Reykjavik (IS)

(72) Inventors: Arinbjörn Viggo Clausen, Reykjavik (IS); Aron Kristbjorn Albertsson, Hafnarfjordur (IS); Gudfinna Halldorsdottir, Reykjavik (IS)

(73) Assignee: Össur Iceland ehf, Reykjavik (IS)

( * ) Notice: Subject to any disclaimer, the term of this patent is extended or adjusted under 35 U.S.C. 154(b) by 0 days.

This patent is subject to a terminal disclaimer.

(21) Appl. No.: 16/050,289

(22) Filed: Jul. 31, 2018

(65) Prior Publication Data

US 2018/0333322 A1 Nov. 22, 2018

Related U.S. Application Data

(63) Continuation of application No. 15/610,372, filed on May 31, 2017, now Pat. No. 10,064,781.
(Continued)

(51) Int. Cl.
*A61H 3/02* (2006.01)
*A61H 3/00* (2006.01)

(52) U.S. Cl.
CPC ..... *A61H 3/02* (2013.01); *A61H 3/0277* (2013.01); *A61H 3/0288* (2013.01);
(Continued)

(58) Field of Classification Search
CPC .... A61H 3/02; A61H 3/00; A61H 2201/0161; A61H 2003/006; A61H 2003/0233;
(Continued)

(56) References Cited

U.S. PATENT DOCUMENTS 1,244,249 A 10/1917 Schlick
2,192,766 A 3/1940 Cederstrom
(Continued)

FOREIGN PATENT DOCUMENTS

DE 202011103635 U1 * 7/2013 ..... A61H 3/02
WO WO 2018/101983 6/2018

OTHER PUBLICATIONS

*The Design of a Compliant Composite Crutch*, Dorota Shortell, MSME; Jeff Kucer, MSME; W. Lawrence Neeley, BSME; Maurice LeBlanc, MSME, CP. Stanford University, Department of Mechanical Engineering, Design Division, Sanford, CA 94305; Rehabilitation Research and Development Center, Department of Veterans Affairs Health Care System, Palo Alto, CA 94304. https://web.archive.org/web/20151110201934/https:/web.stanford.edu/group/rrd/Projects/2kprojects/crutch/crutch.html, archive.org indicates available on-line Nov. 10, 2015, in 16 pages.
(Continued)

*Primary Examiner* — David R Dunn
*Assistant Examiner* — Danielle Jackson
(74) *Attorney, Agent, or Firm* — Knobbe, Martens, Olson & Bear, LLP

(57) ABSTRACT

Various features for improving the performance of crutches are provided. A crutch can flex at one or more locations or include composite material to provide energy storage and return to the user during ambulation. In some aspects, a crutch is provided that can propel the user forward during ambulation. The crutch can be hollow at one or more locations to allow for increased flexibility and narrower at one or more locations to enhance springiness of the crutch.

20 Claims, 38 Drawing Sheets

Related U.S. Application Data

(60) Provisional application No. 62/428,960, filed on Dec. 1, 2016.

(52) U.S. Cl.
CPC *A61H 2003/006* (2013.01); *A61H 2003/0211* (2013.01); *A61H 2201/1638* (2013.01)

(58) Field of Classification Search
CPC ..... A61H 1/0262; A61H 2003/0227; A61H 2003/0238; A61H 2201/0157; A45B 3/00; A45B 2009/007; A45B 2200/055; A45B 3/12
USPC ..... 135/65–66, 71–73, 76, 82, 84, 86; 623/49, 52–53, 55, 57, 60
See application file for complete search history.

(56) References Cited

U.S. PATENT DOCUMENTS 3,738,674 A 6/1973 Pauls
5,038,811 A * 8/1991 Gilmore ..... A61H 3/02 135/71
5,331,989 A * 7/1994 Stephens ..... A45B 9/00 135/65
5,458,143 A 10/1995 Herr
5,766,265 A 6/1998 Phillips
5,984,359 A * 11/1999 Faiks ..... A63C 11/22 135/86
6,562,075 B2 * 5/2003 Townsend ..... A61F 2/60 623/38
7,735,501 B2 6/2010 Townsend
7,998,096 B1 8/2011 Skoog
8,047,216 B2 * 11/2011 Parry ..... A45B 7/00 135/65
8,474,470 B2 7/2013 Albertyn
8,814,212 B2 * 8/2014 Bennett ..... A63C 11/24 280/819
9,089,194 B2 7/2015 Tessier
9,662,263 B2 5/2017 Hsiao-Wecksler
9,763,502 B2 9/2017 Rudin
10,064,781 B2 9/2018 Clausen et al.
10,137,355 B2 * 11/2018 Brennan ..... A63C 17/0013
D851,388 S 6/2019 Clausen et al.
2004/0107981 A1 * 6/2004 Smith ..... A45B 9/00 135/65
2004/0250845 A1 12/2004 Rudin et al.
2006/0185703 A1 8/2006 Townsend et al.
2010/0206348 A1 8/2010 Markou
2012/0015785 A1 * 1/2012 Burroughs ..... A63C 11/221 482/139
2013/0226058 A1 8/2013 Sanders et al.
2016/0287464 A1 10/2016 Younger
2017/0156458 A1 6/2017 Hayden
2018/0153759 A1 6/2018 Clausen et al.

OTHER PUBLICATIONS

Communication Relating to the Results of the Partial International Search, International Application No. PCT/US2017/035288 dated Aug. 17, 2017 12 pages.
PCT International Written Opinion and Search Report, re PCT App. No. PCT/US2017/035288, dated Oct. 18, 2017.

* cited by examiner

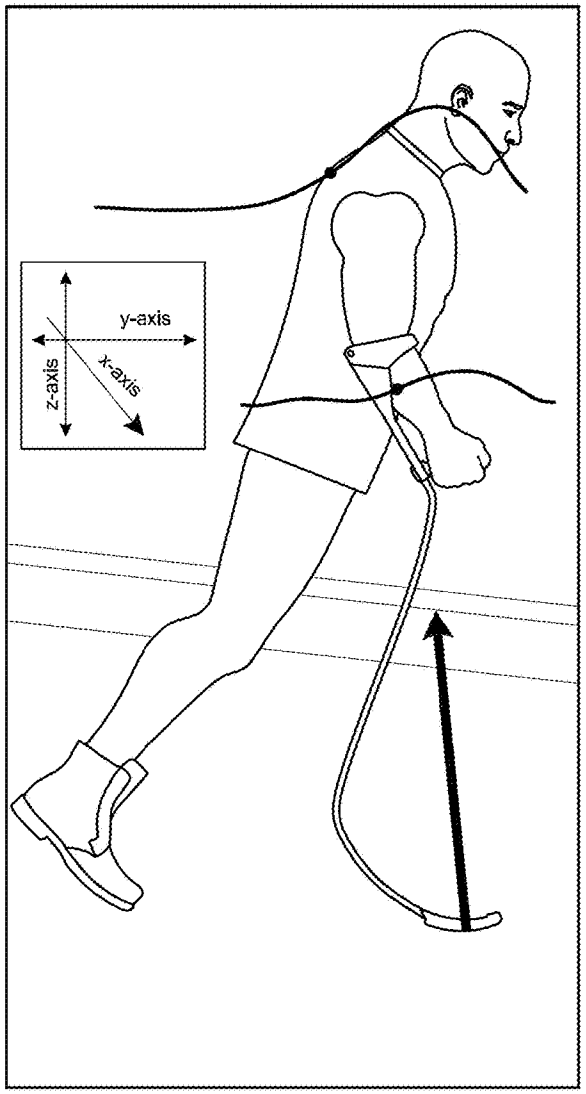
FIG. 21B
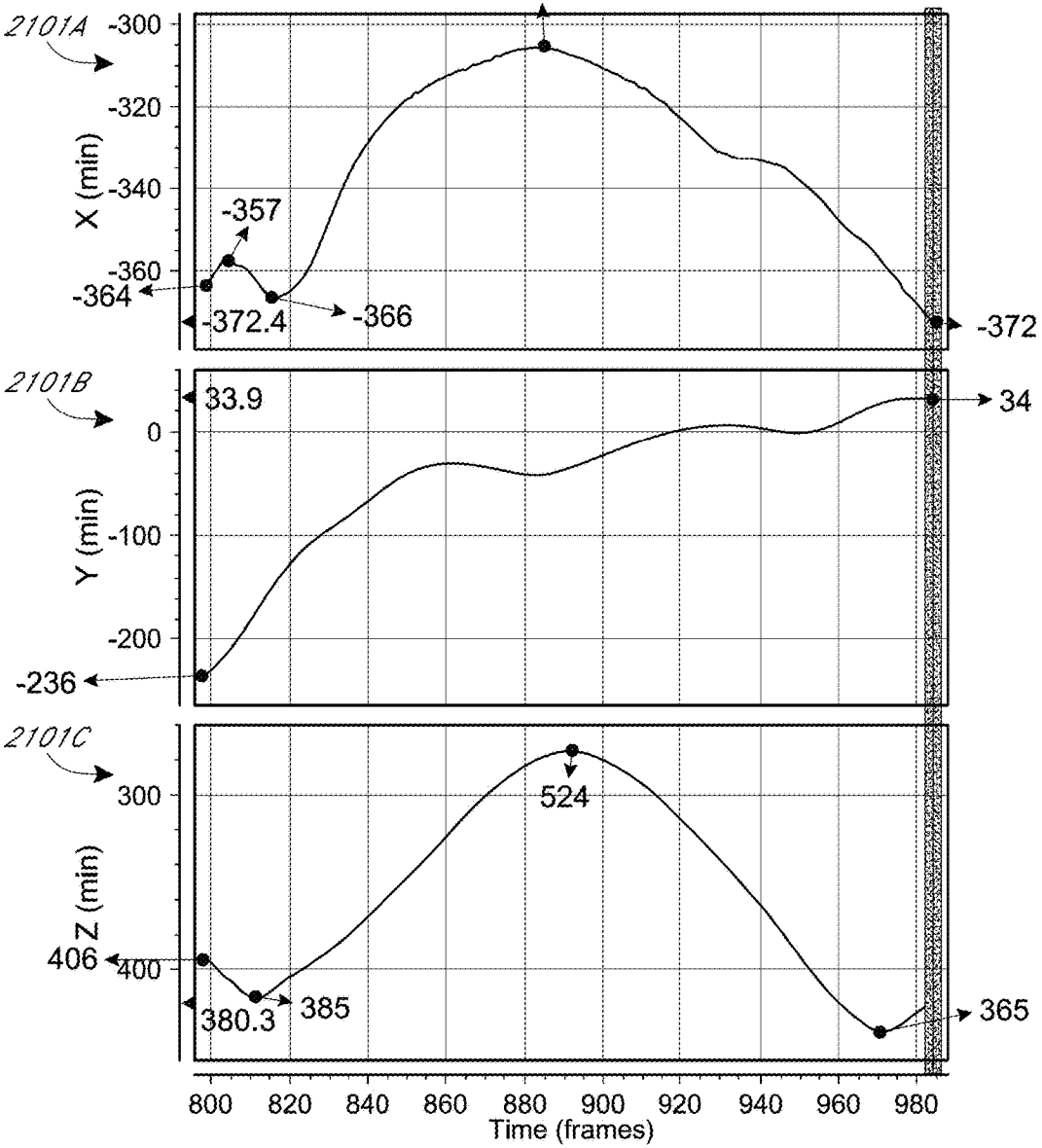

CRUTCH WITH ENERGY STORAGE AND ENERGY RETURN

CROSS-REFERENCE TO RELATED APPLICATIONS

The present application is a continuation of U.S. patent application Ser. No. 15/610,372, filed May 31, 2017, and entitled, CRUTCH WITH ENERGY STORAGE AND ENERGY RETURN, which claims priority benefit to U.S. Provisional Application No. 62/428,960, filed Dec. 1, 2016, and entitled, CRUTCH WITH ENERGY STORAGE AND ENERGY RETURN, which is hereby incorporated herein by reference in its entirety. Any and all applications for which a foreign or domestic priority claim is identified in the Application Data Sheet as filed with the present application are incorporated by reference under 37 CFR 1.57 and made a part of this specification.

BACKGROUND

Field

The present application generally relates to crutches, and more particularly, to crutches configured to provide energy storage and return to a user during ambulation.

Description of the Related Art

A crutch is a mobility aid that can be used to support all or part of a user's body weight. A crutch can be provided for one or both sides of the body and can be configured to reach from a user's underarm, wrist area, hand and the like to a walking surface.

There are several disadvantages to traditional crutches. Many people have difficulty coordinating movement with crutches due to the uncomfortable positioning of the crutches at the underarms. Further, the user may quickly become fatigued and unable to use the crutches for a prolonged period of time. Additionally, the stress placed on the user's hands and wrists by conventional crutch designs may cause further discomfort or injury.

SUMMARY

It would be desirable to have a crutch that allows the user to make use of his or her elbows and/or upper arms to support his or her body weight. It would also be desirable to have crutch capable of propelling the user forward, thereby reducing fatigue during ambulation and allowing the user to utilize the crutches for a prolonged period of time (e.g., while at work, etc.).

In some aspects a crutch is provided that can flex at one or more locations to provide energy storage and return to the user during ambulation. In some aspects, a crutch is provided that can propel the user forward during ambulation.

In some embodiments, a crutch configured to provide energy storage and return to a user during ambulation includes an elongate member having one or more portions configured to flex and un-flex responsive a force applied by a user's weight during ambulation. The flexion can provide energy storage during ambulation and the un-flexion can return the stored energy to the user. In some examples, at least a portion of the elongate member is hollow. In some examples, at least a portion of the elongate member incorporates composite material.

The crutch of the preceding paragraph may optionally include a hand grip proximately attached to the elongate member and configured to be grasped by a hand of the user.

The crutch of any of the preceding paragraphs may optionally include an arm cuff proximately attached to the elongate member and configured to couple to an arm of the user.

In some embodiments, a crutch configured to provide energy storage and return to a user during ambulation includes an elongate member, an arm cuff and a hand grip. The elongate member can include a proximal portion, a central portion distally connected to the proximal portion via a first transition section and extending at an angle relative to the central portion, and a curved distal portion distally connected to the central portion via a second transition portion. One or more of the proximal portion, the central portion, and the curved distal portion can be configured to flex and un-flex responsive a force applied by a user's weight during ambulation. The flexion of said one or more portions can provide energy storage during ambulation and the un-flexion of said one or more portions can return the stored energy to the user, which can advantageously help propel the user during ambulation and thereby reduce the amount of energy expended by the user during ambulation. The arm cuff can be proximately attached to the proximal portion and configured to couple to an arm of a user. The hand grip can be attached to the proximal portion and proximate to the arm cuff such that a forearm of the user can rest on the proximal portion when the user's arm is coupled to the arm cuff and the user is grasping the hand grip. In some examples, one or more portions of the elongate member is hollow. In some embodiments, the first transition section can optionally include a powered or mechanical joint. In some embodiments, a position of the hand grip on the proximal portion can optionally be adjustable to accommodate different users.

The crutch of the preceding paragraph may also include composite material configured to provide energy storage and return to the user during ambulation.

The crutch of any of the preceding paragraphs may optionally also include a sole attached to a bottom surface of the curved distal portion.

The crutch of any of the preceding paragraphs may optionally also include a pad of resilient material disposed on the proximal portion between the cuff and the hand grip and configured to support the user's forearm thereon. In some examples, the pad of resilient material is a foam pad.

All of these embodiments are intended to be within the scope of the disclosure herein. These and other embodiments will become readily apparent to those skilled in the art from the following detailed description having reference to the attached figures, the disclosure not being limited to any particular disclosed embodiment(s).

BRIEF DESCRIPTION OF THE DRAWINGS

These and other features, aspects, and advantages of the present disclosure are described with reference to the drawings of certain embodiments, which are intended to schematically illustrate certain embodiments and not to limit the disclosure.

FIG. 21B illustrates an X, Y, and Z graph corresponding to a user propelling himself using two crutches with energy storage at the same time and swinging through with both feet.

DETAILED DESCRIPTION

Although certain embodiments and examples are described below, those of skill in the art will appreciate that the disclosure extends beyond the specifically disclosed embodiments and/or uses and obvious modifications and equivalents thereof. Thus, it is intended that the scope of the disclosure herein disclosed should not be limited by any particular embodiments described below.

The present disclosure provides various examples of crutches and features for crutches. In some embodiments, crutches are configured to provide energy storage and energy return to a user during ambulation. For example, when a user initially applies a force to the crutch, such as at the start of ambulation, the crutch can flex at one or more locations, thereby providing increased springiness (e.g., energy return) at push-off, which can advantageously facilitate the ambulation of the user. Various features as described herein can advantageously absorb and release energy to assist in propelling the user forward during use, thereby improving user performance. In some embodiments, medical crutches can be adapted for use while jogging, running, etc.

Figure 1:
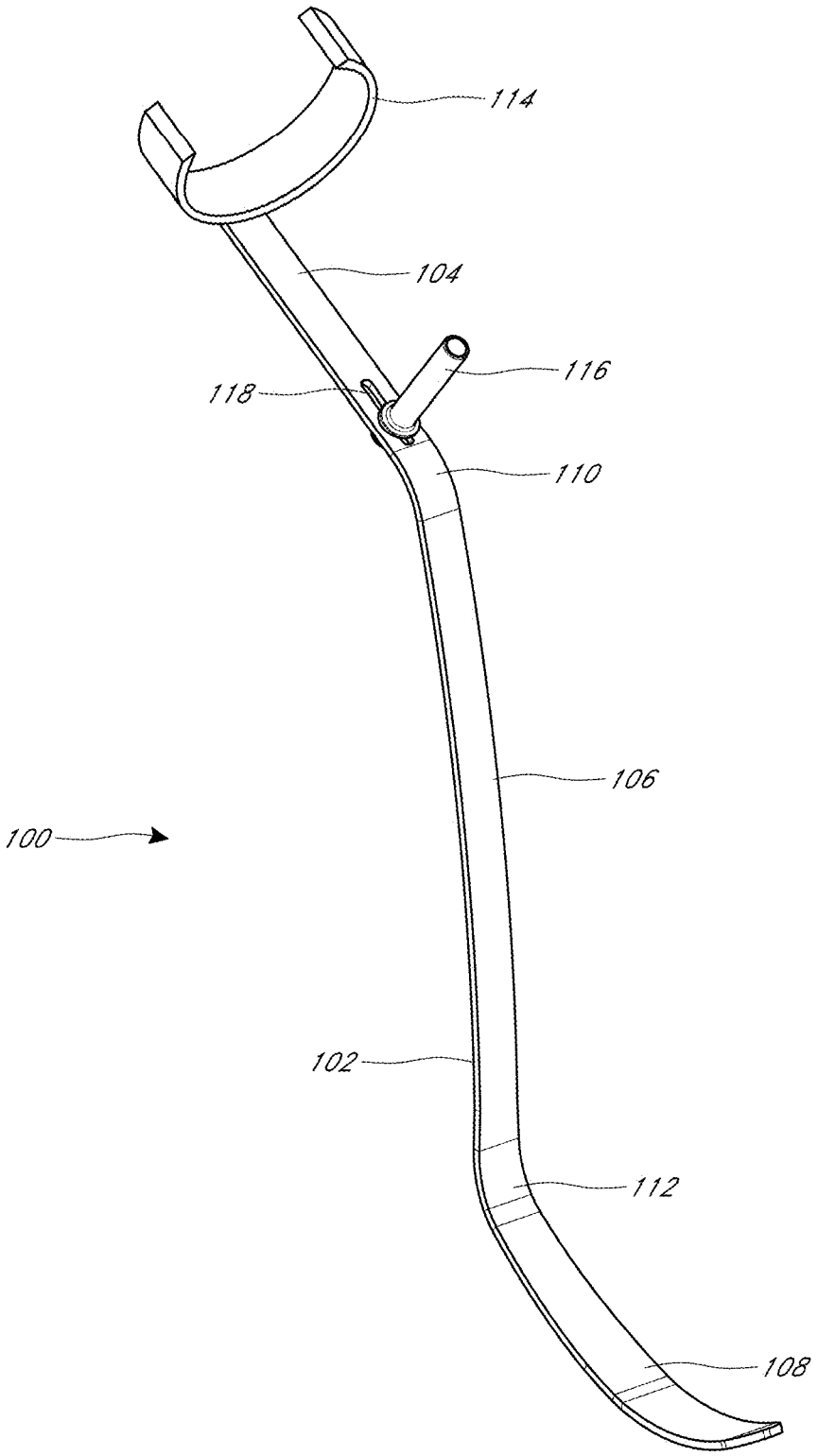
FIG. 1 illustrates a crutch configured to provide energy storage and return to a user during ambulation, according to some embodiments.

FIG. 1 illustrates a crutch 100 configured to provide energy storage and return to a user during ambulation, according to some embodiments. A crutch 100 such as the one illustrated in FIG. 1 is designed to efficiently store and release energy produced during ambulation to improve crutch assistance and ease of use. The crutch 100 includes an elongate member 102, an arm cuff 114 and a hand grip 116. The elongate member 102 includes a proximal portion 104, a central portion 106 distally connected to the proximal portion 104 via a first transition section 110 and extending at an angle relative to the central portion 106, and a curved distal portion 108 distally connected to the central portion 106 via a second transition portion 112. Optionally, one or more of the proximal portion 104, central portion 106, and the curved distal portion 108 can be oriented medially to aid in ambulation.

According to some aspects, the elongate member 102 can be a single, shaped member. For example, the first and second transition sections 110, 122 can include bends in the elongate member 102. In some aspects, the elongate member 102 can be a combination of two or more attached portions.

For example, the elongate member 102 can include one or more joints that can connect one or more portions of the elongate member 102. In some aspects, one or more of the proximal portion 104, the central portion 106, curved distal portion 108, the arm cuff 114 and the hand grip 116 are optionally detachable from the crutch 100.

The arm cuff 114 is proximately attached to the proximal portion 104 and can couple to an arm of a user or below the user's elbow. The cuff can provide increased support to a user by reducing strain on a user's arm. This can help to reduce wrist pressure and maintain better posture and mobility control. In some examples, the arm cuff 114 can engage a user's shoulder, bicep, forearm or wrist. In some instances, an arm cuff is not included in the crutch 100 but may be an optional attachment.

The hand grip 116 is attached to and extends outwardly from the proximal portion 104 at a location distal of the arm cuff 114. In some examples, the hand grip 116 can be attached to the first transition area 110 and/or the central portion 106. In some instances, a hand grip is not included in the crutch 100 but may be an optional attachment.

As depicted, in some embodiments, the position of the hand grip 116 along the elongate member 102 is adjustable, for instance, to accommodate users with different preferences or arm sizes. The crutch 100 can include an aperture 118 disposed within the proximal portion 104 where the position of the hand grip 116 is slidably adjustable along the aperture 118. In some examples, the hand grip 116 can be locked into position after an adjustment is made. One of skill in the art would appreciate the position of the hand grip 116 may be adjusted in a variety of different ways.

In some embodiments, the hand grip 216 can extend outwardly from the elongate member 102 at an angle such that the wrist of a user is generally maintained in a neutral and comfortable position. In some examples, the orientation of the hand grip 116 can be adjusted by the user.

The hand grip 216 can be contoured or grooved to fit a hand or fingers of a user such that the hand grip provides an anatomical fit of the user's hand. In other examples, the hand grip is not contoured but instead is generally cylindrically shaped. The hand grip can be made of material that prevents or partially inhibits the hand from slipping off the hand grip.

The curved distal portion 108 can have an overall curved profile. The curved distal portion 108 can advantageously absorb and release energy to assist in propelling the user forward during use, thereby improving user performance. For example, responsive to vertical forces generated during ambulation, the curved distal portion 108 can flex and provide energy return to the user at push-off. In some examples, vertical forces generated at the start of ambulation are stored and translated into a linear motion. This action reduces the need for the user to actively push his or her body forward using the crutch and also can equalize stride length. In addition, it can provide for a more natural gait and reduced crutching and/or walking effort.

In some aspects, the curved distal portion 108 has a varying width along its length. For example, curved distal portion 108 can have a proximal, central, and distal section. The central section can be narrower (i.e., have a smaller width transverse to the longitudinal axis of the curved distal portion when viewed from the front) than the distal section. Similarly, the central section can be narrower than the proximal section or have the same width as the proximal section. In some examples, the central section can be narrower than the distal section so that the width of the curved distal portion flares outward (e.g., gradual flare) from the central section to the distal section. A narrowed central section can advantageously reduce drag on the crutch (e.g., by reducing the amount of surface area of the crutch that faces airflow during use). A narrowed central section can also advantageously enhance springiness (e.g., reduced resistance to flexion) of the crutch in use. In some embodiments, the curved distal portion 108 can generally have a "J" shape having a substantially straight and vertical proximal section and a generally curved distal section.

The elongate member 102 can be made of a composite material (such as carbon fiber, glass fiber, a carbon-glass fiber composite). In some embodiments, the elongate member 102 can be made of other suitable materials (e.g., metals, such as aluminum, steel, or titanium. In some examples, the crutch preferably includes composite material that can flex to provide energy storage and return to the user during ambulation. For instance, a carbon fiber composite can allow more flexion than a metal, thereby offering increased energy storage (when a portion of the crutch 100 is flexed under load) and energy release (when un-flexed responsive to a release of the applied load).

Figure 2A:
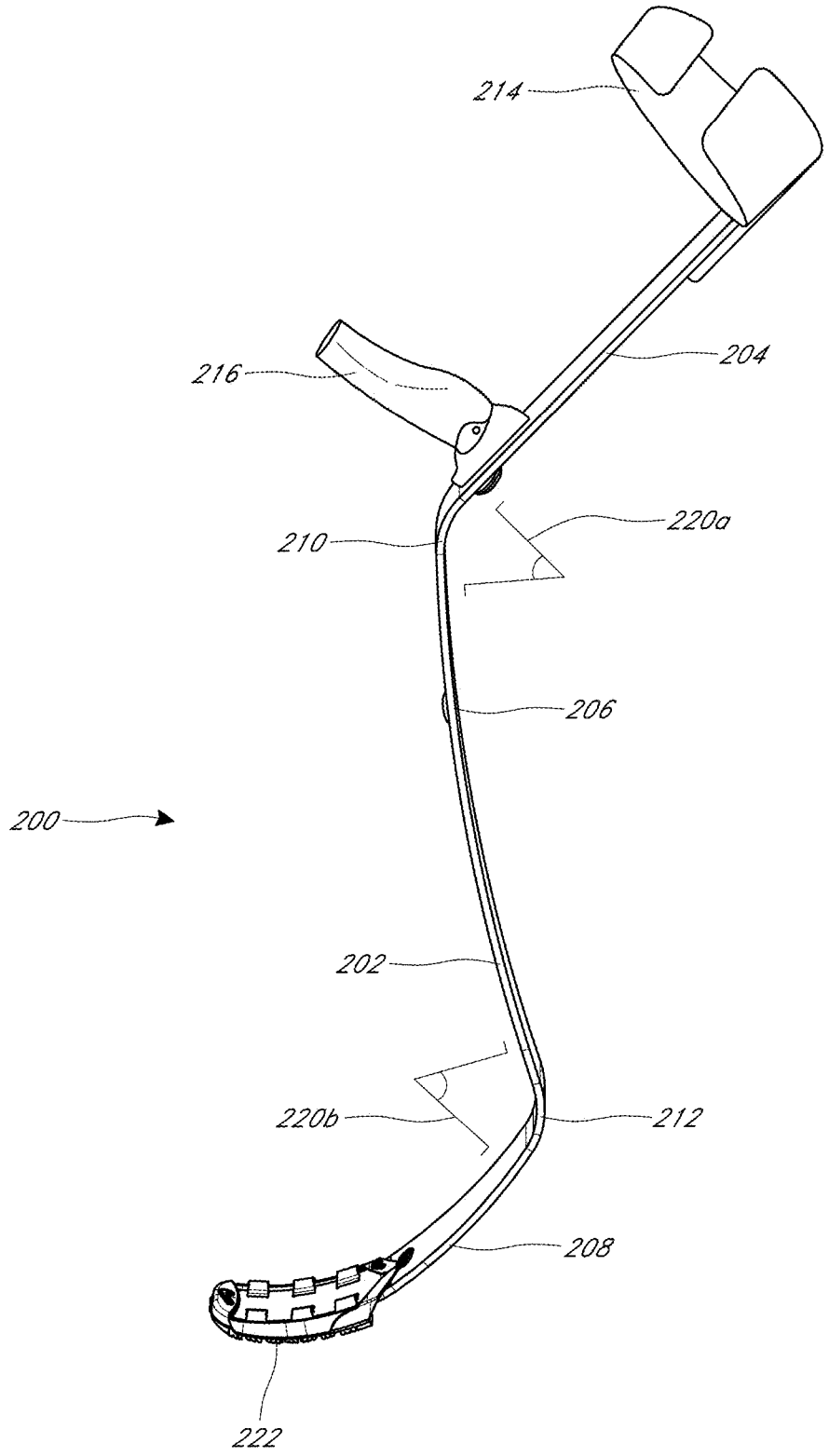
FIG. 2A illustrates a crutch configured to provide energy storage and return to a user during ambulation, according to some embodiments.

FIG. 2A illustrates a perspective view of a crutch configured to provide energy storage and return to a user during ambulation, according to some embodiments. The crutch 200 includes an elongate member 202, an optional arm cuff 214, an optional hand grip 216 and an optional sole 222. The elongate member 202 includes a proximal portion 204, a central portion 206 distally connected to the proximal portion 204 via a first transition section 210 and extending at an angle relative to the central portion 206, and a curved distal portion 208 distally connected to the central portion 206 via a second transition portion 212. Optionally, one or more of the proximal portion 204, central portion 206, and the curved distal portion 208 can be oriented medially to aid in ambulation. The distal portion 208 (e.g., the "foot portion") of the crutch 200 can bend or flex along its length (e.g., including at the distal end), which advantageously improves (e.g., increases the length of) the stride when using the crutch to propel the user forward (e.g., by a greater amount than if the distal portion 208 did not bend or flex). The crutch 200 rolls over along the contact surface of the distal portion 208 during use.

The first transition section 210 is angled such that the proximal portion 204 extends at an angle 220*a* relative to the central portion 206. In some examples, the angle 220*a* is an obtuse angle (for instance, about 100, 105, 110, 115, 120, 125, 130, 135, 137, 140, 145, 150, 155, 160 or 165 degrees). In some examples, the proximal portion 204 is generally aligned with the central portion 206 such that the angle 220*a* is a relatively straight angle (for instance, about 170, 175, 180, 185, or 190 degrees).

The second transition section 212 is angled such that the distal portion 208 extends at an angle 220*b* relative to the central portion 206. In some examples, the angle 220*b* is an obtuse angle (for instance, about 100, 105, 110, 115, 120, 125, 130, 133, 135, 137, 140, 145, 150, 155, 160 or 165 degrees). In some examples, the central portion 206 is generally aligned with the distal portion 208 such that the angle 220*b* is a relatively straight angle (for instance, about 170, 175, 180, 185, or 190 degrees).

The crutch 200 optionally includes a sole 222 that can attach to a bottom surface of the curved distal portion. The sole 222 can be a protective layer disposed on the crutch 200 such that it provides a barrier between the crutch 200 and a walking surface.

Figure 2B:
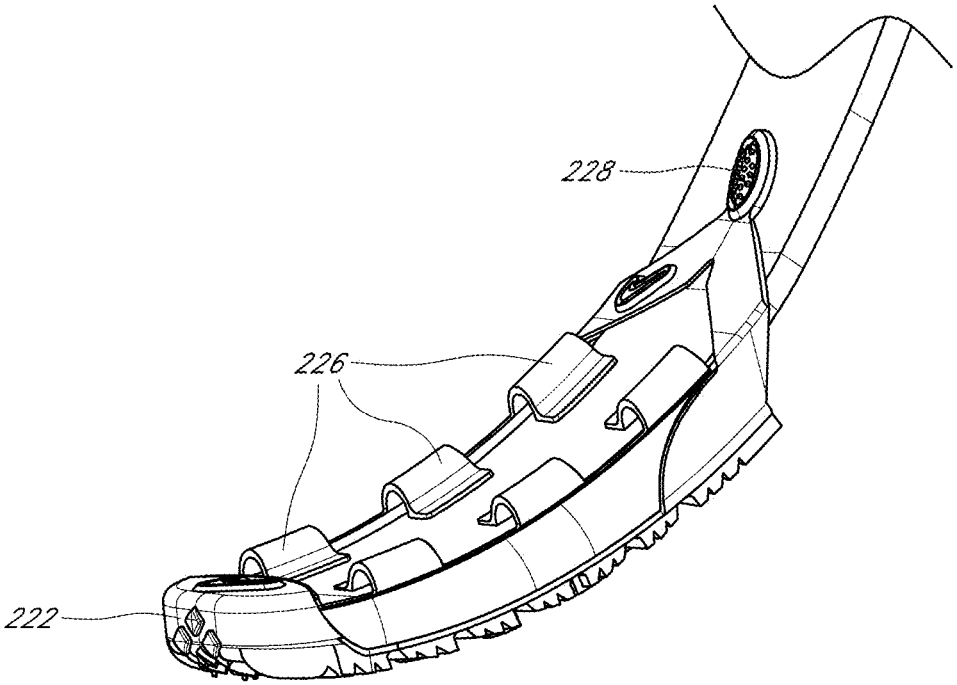
FIGS. 2B-2C illustrate perspective views of a sole attached to the curved distal portion of the crutch of FIG. 2A.
Figure 2C:
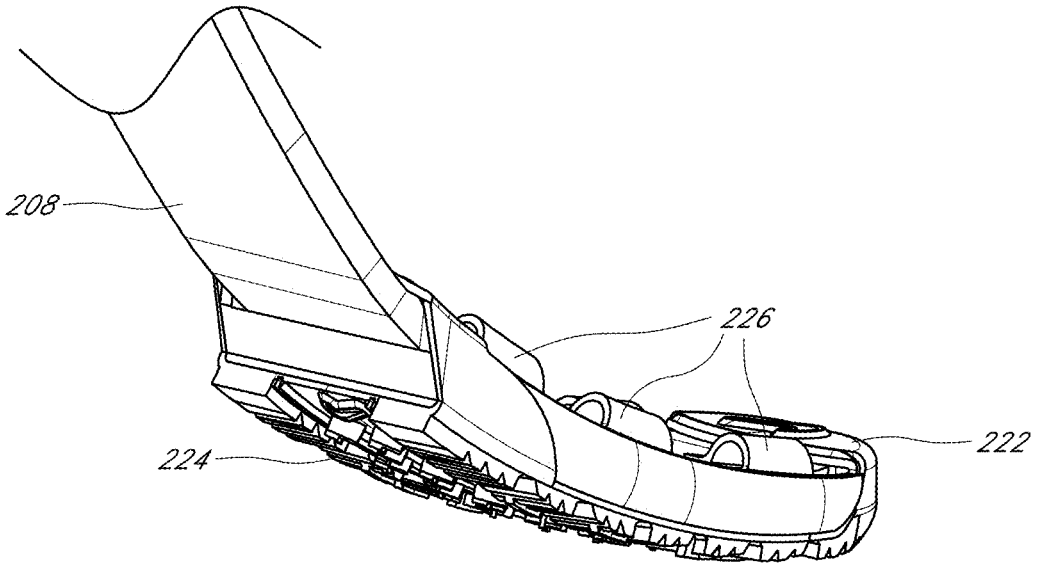

FIGS. 2B-2C illustrate perspective views of the sole 222 attached to the curved distal portion 208 of the crutch 200 of FIG. 2A. The sole 222 can provide traction to the crutch 200 during ambulation and to serve as a barrier between the curved distal portion 208 and a walking surface (e.g., pavement, dirt path, floor, etc.). Optionally, the sole 222 can tread pattern that allows it to be used in various weather conditions (e.g., sun, rain, snow, etc.) or various terrains (e.g., dry, wet, grassy, gritty, hard, or soft surfaces). For example, the sole 222 can allow a user to easily transition between a first surface, such as pavement, to a second surface, such as snow, sand or gravel. Optionally, the sole 222 can have a contact surface (e.g., outsole 224) with a high grip material that facilitates the ability of the sole 222 to be used on a variety of terrains or in various weather conditions. The sole 222 (e.g., the outsole 224) can include, but is not limited to, rubber, thermoplastic elastomers (TPE), fabric, thermoplastic polyurethane (TPU), polyurethane (PU), cork, ethylvinyl acetate (EVA), or leather, or a combination of any of these. Optionally, the sole 222 can include one or more protrusions (e.g., on the outsole 224), such as cleats or spikes, made from, for example, carbide, which can further aid in gripping the ground surface and providing traction to the crutch 200.

The sole 222 can be removably or fixedly attached to the curved distal portion 208. In some examples, the sole 222 is attached to the curved distal portion 208 via a plurality of tabs 226, such that the sole 222 clips onto the curved distal portion 208. The plurality of tabs 226 can serve as "fingers" that wrap snugly around the curved distal portion 208 for secure attached and easy on-off. In some examples, the sole includes a stretch rubber leash 228 with a tactile grip tab for easy placement over a medallion fastener, thereby providing additional secured attachment to the curved distal portion 208. While FIGS. 2B-2C illustrate a sole includes nine nylon plastic tabs 226, one of ordinary skill in the art would appreciate that the sole 222 can include any suitable number of tabs and can be made of any suitable material. One of ordinary skill in the art would understand that there are countless other ways in which the sole 222 can be attached to the curved distal portion 208 such as, for example, a sleeve that slides onto the curved distal portion 208, or by adhesive, screw, or straps. In another embodiment, the sole 222 can instead be permanently attached (e.g., via an adhesive) to at least a portion of the length of the distal portion 208.

The sole 222 can include a lightweight, durable composite material. In some examples, the sole 222 can have an integrated layered sole including an outsole, midsole and thermal plastic urethane (such as Aeroply), made of recycled Nike Air Bag units. The outsole 224 can provide crutch traction during ambulation.

Figure 2D:
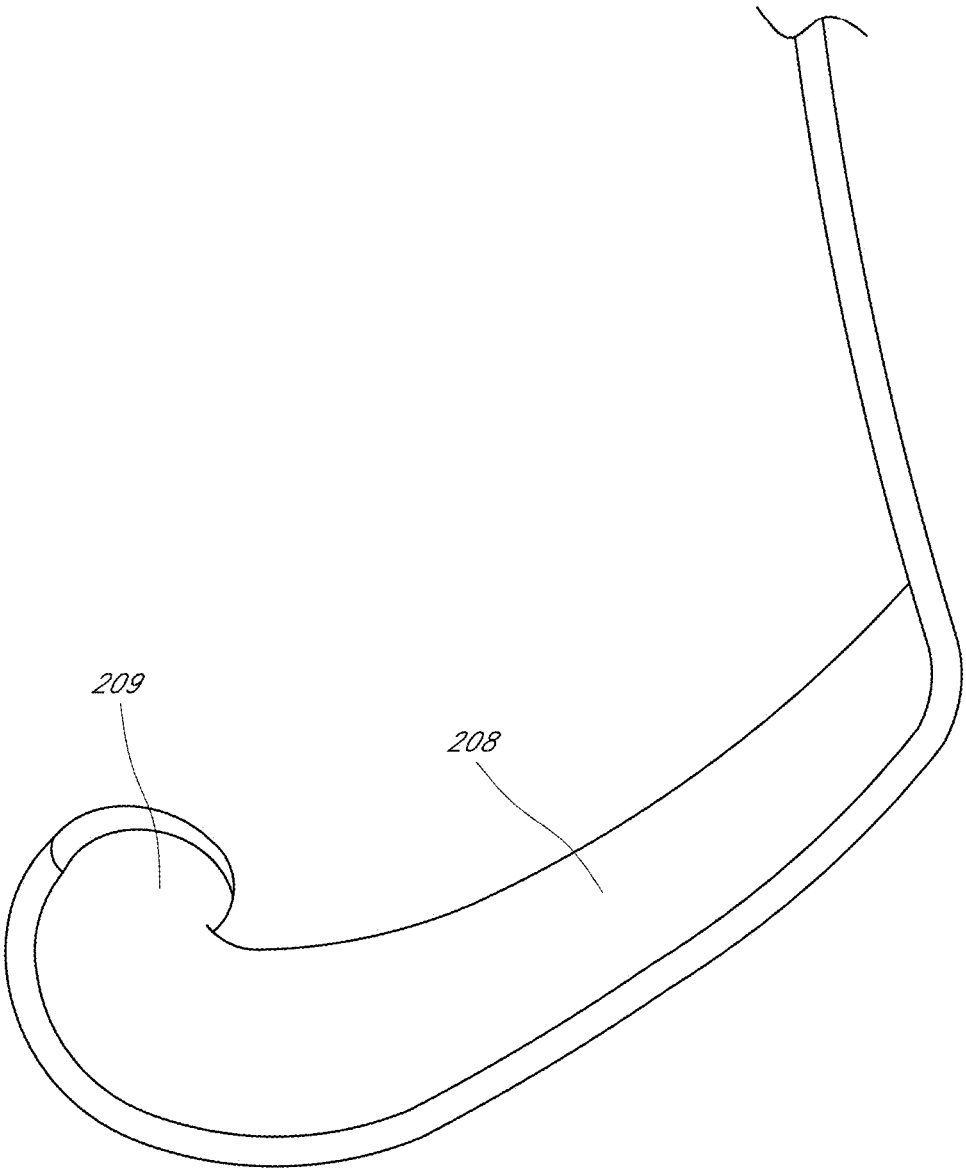
FIG. 2D illustrates a curved distal portion having a curved toe.

FIG. 2D illustrates a crutch having distal portion 208 with an inclined or curved toe 209 (sometimes referred to as an Aladdin toe). In some instances, the shape of the curved distal portion (e.g., the shape of the contact surface) contributes to step length. As the length of the contact surface increases, the step length can also increase. Thus, in some embodiments, the curved distal portion is shaped such that the contact portion increases during toe-off. Advantageously, the inclined or curved toe end 209 can further increase the step or stride length of the crutch 200 during use (e.g., as crutch rolls over on curved toe at the end of a stride using the crutch 200), as compared with a similar crutch that does not have a curved toe end.

Figure 2E:
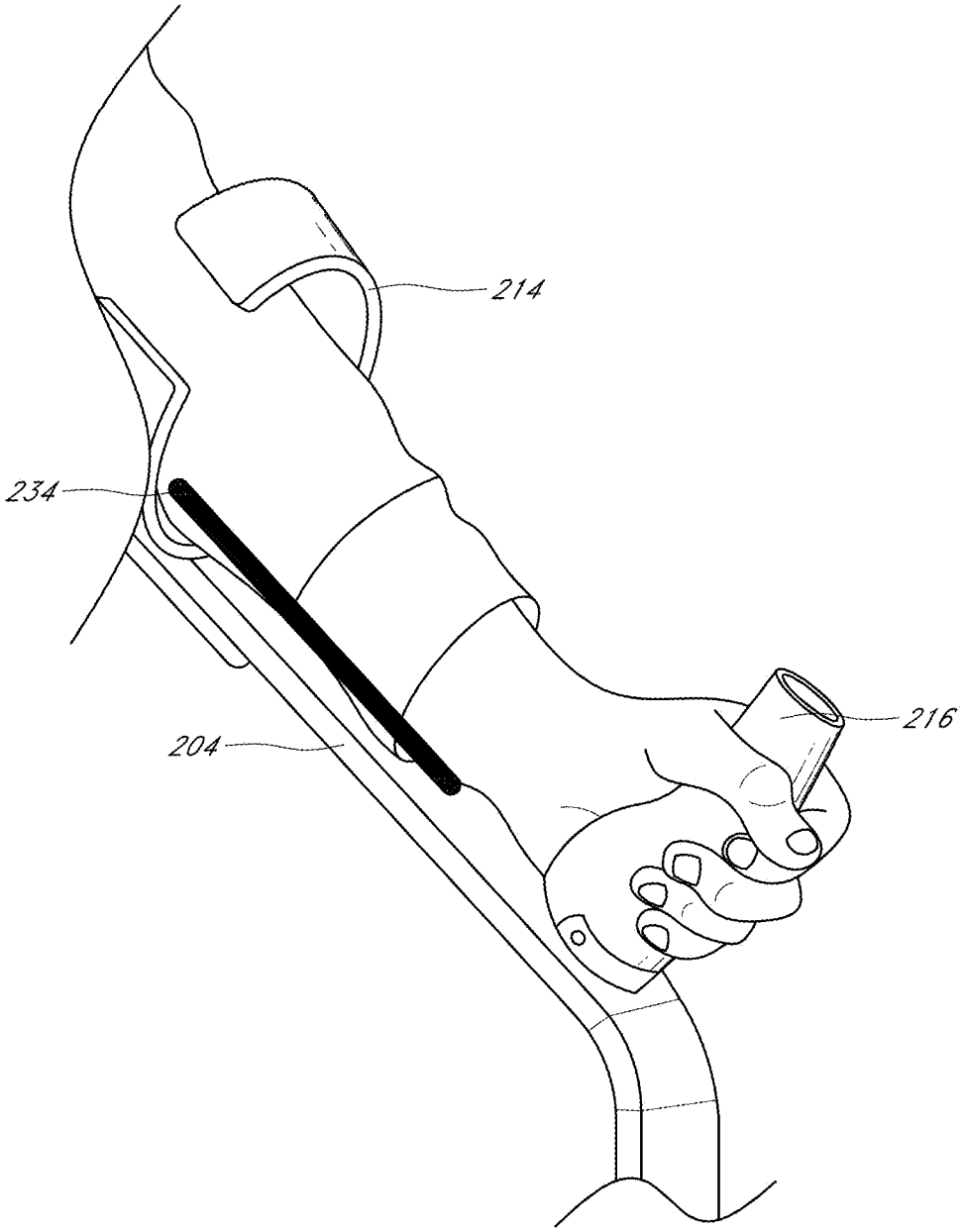
FIG. 2E illustrates a partial view of the crutch of FIG. 2A coupled to an arm of a user.

FIG. 2E illustrates a scaled view of the crutch 200 of FIG. 2A coupled to an arm of a user. The hand grip 216 is attached to the proximal portion 204 and proximate to the arm cuff 214 such that a forearm of the user can rest on the proximal portion 204 when the user's arm is coupled to the arm cuff 214 and the user is grasping the hand grip 216.

The crutch 200 can include a pad of resilient material 234 disposed on the proximal portion 204 to provide support for a user's arm thereon. In some examples, the pad is disposed between the arm cuff 214 and the hand grip 216. In other examples, the pad can extend from an end of the crutch (approximately where the user elbow will lie) to a point between the arm cuff and hand grip (approximately where the middle of a user's arm will lie). In some aspects, the pad can provide a full anatomical fit between the user's arm and the crutch. In other aspects, the pad is partially contoured to the user's arm or alternatively has a flat surface. In some examples, the pad is a foam pad.

The arm cuff 214 can be a strap, a cuff, and/or any support element that can at least partially encompass a portion of an arm of a user. The arm cuff 214 can be padded to improve comfort and be ideal for long-term use. The arm cuff 214 can include plastic, metal, or any other suitable material known by one of skill in the art.

Figure 3A:
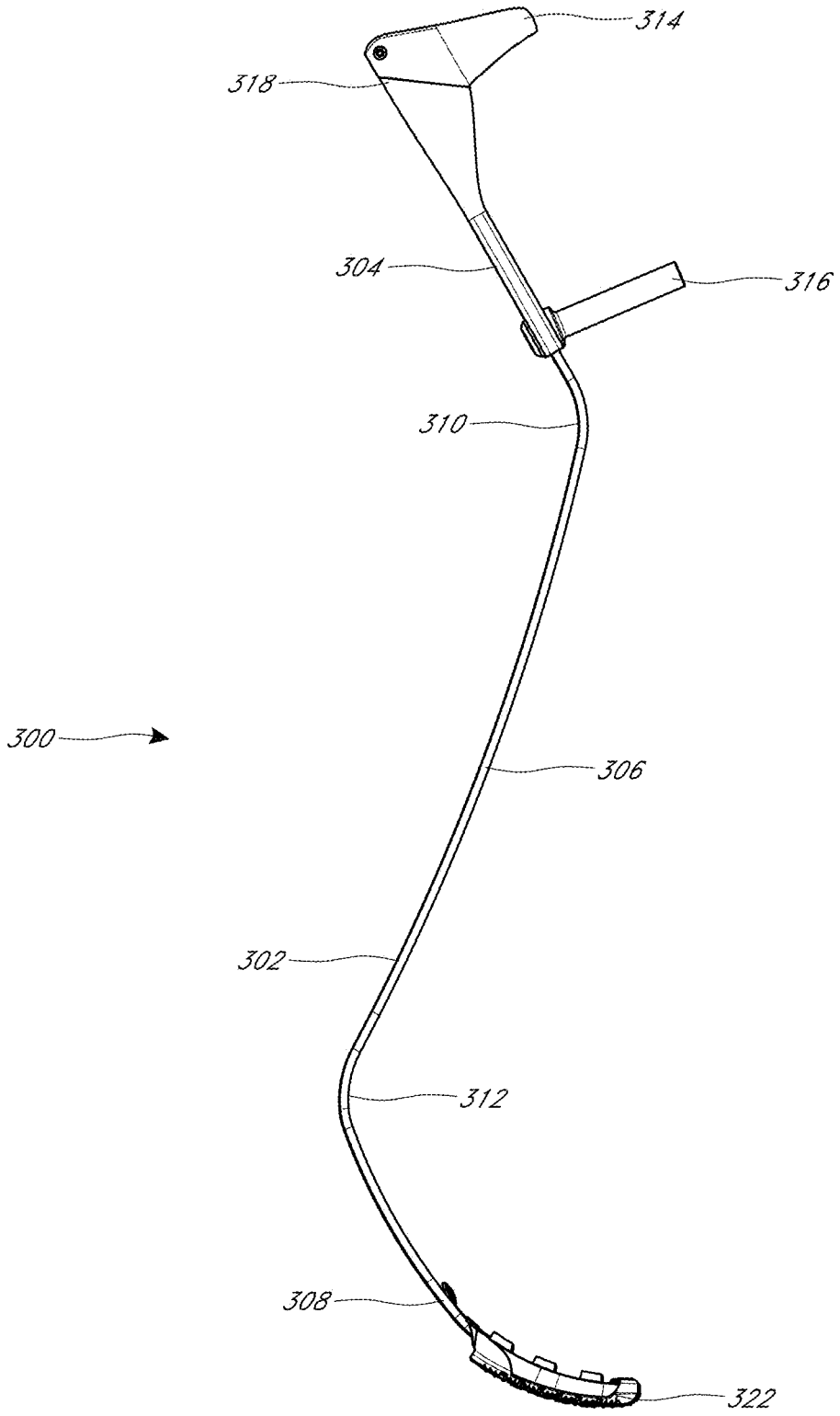
FIG. 3A illustrates a crutch configured to provide energy storage and return to a user during ambulation, according to some embodiments.

FIG. 3A illustrates a perspective view of a crutch 300 that can provide energy storage and return to a user during ambulation, according to some embodiments. The crutch 300 includes an elongate member 302, an optional arm cuff 314 having a hinge 318, an optional hand grip 316 and an optional sole 322. The elongate member 302 includes a proximal portion 304, a central portion 306 distally connected to the proximal portion 304 via a first transition section 310 and extending at an angle relative to the central portion 306, and a curved distal portion 308 distally connected to the central portion 306 via a second transition portion 312.

Figure 3B:
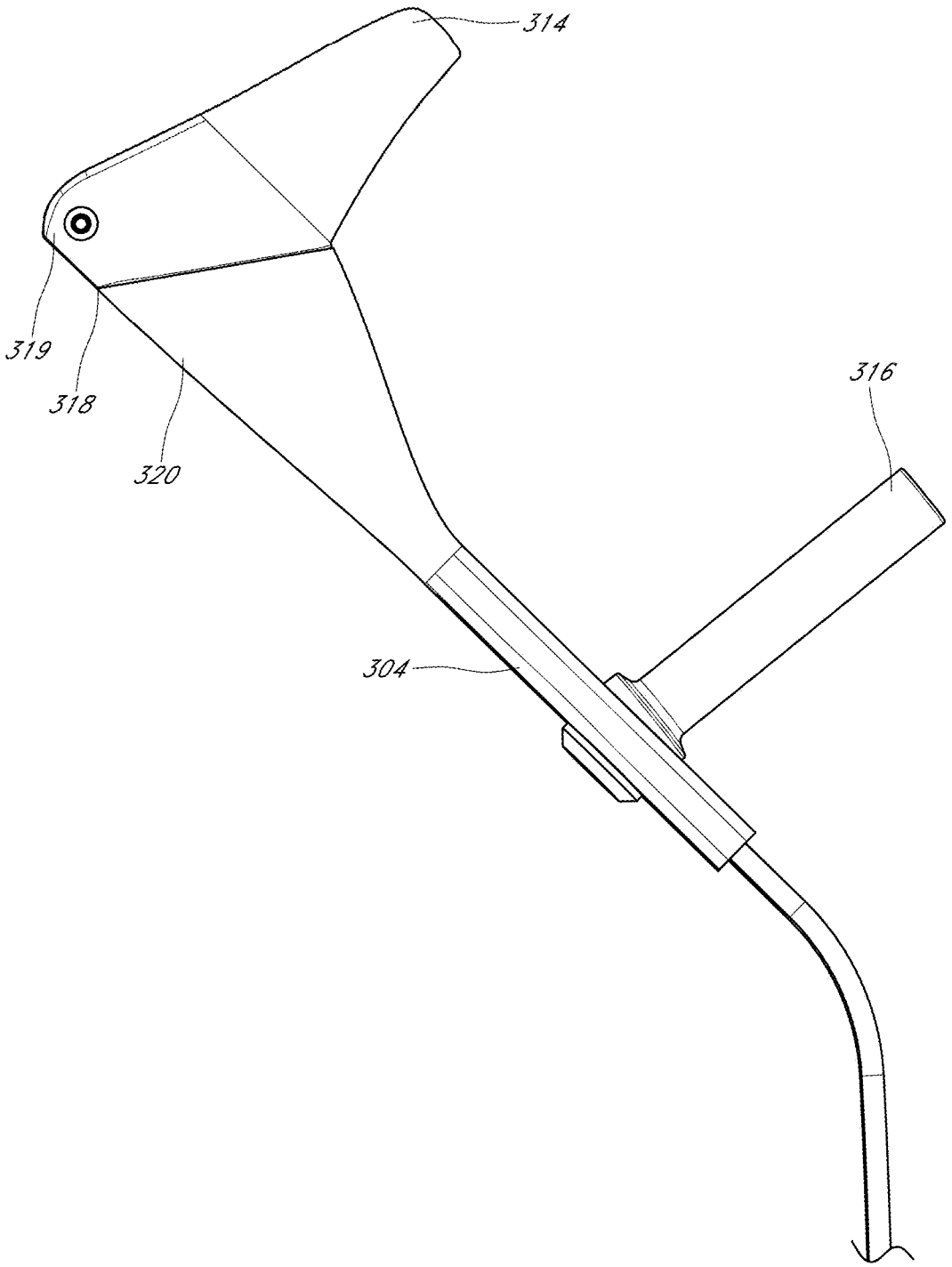
FIGS. 3B-3D illustrate partial views of a proximal portion of the crutch of FIG. 3.

The hinge 318 of the arm cuff 314 advantageously allows a user to utilize his or her arm for non-crutch activities (e.g., shaking hands, opening a door, talking on the phone) without having to detach from the crutch 300 (e.g., without losing contact with the crutch 300). For example, FIGS. 3B-3D respectively illustrate the hinge 318 of FIG. 3A in a closed position, partially open position, and open position. During ambulation, at least a portion of the user's arm resides in the arm cuff 314 and the user's hand grasps the hand grip 316. Accordingly, during ambulation the hinge 318 is in a closed or neutral configuration (as illustrated in FIG. 3B) such that little to no gap exists between the top portion 319 of the arm cuff 314 and a lower portion 320 of the arm cuff 314. The hinge 318 advantageously allows the top portion 319 of the arm cuff 314 to pivot relative to the lower portion 320 of the arm cuff 314.

Figure 3C:
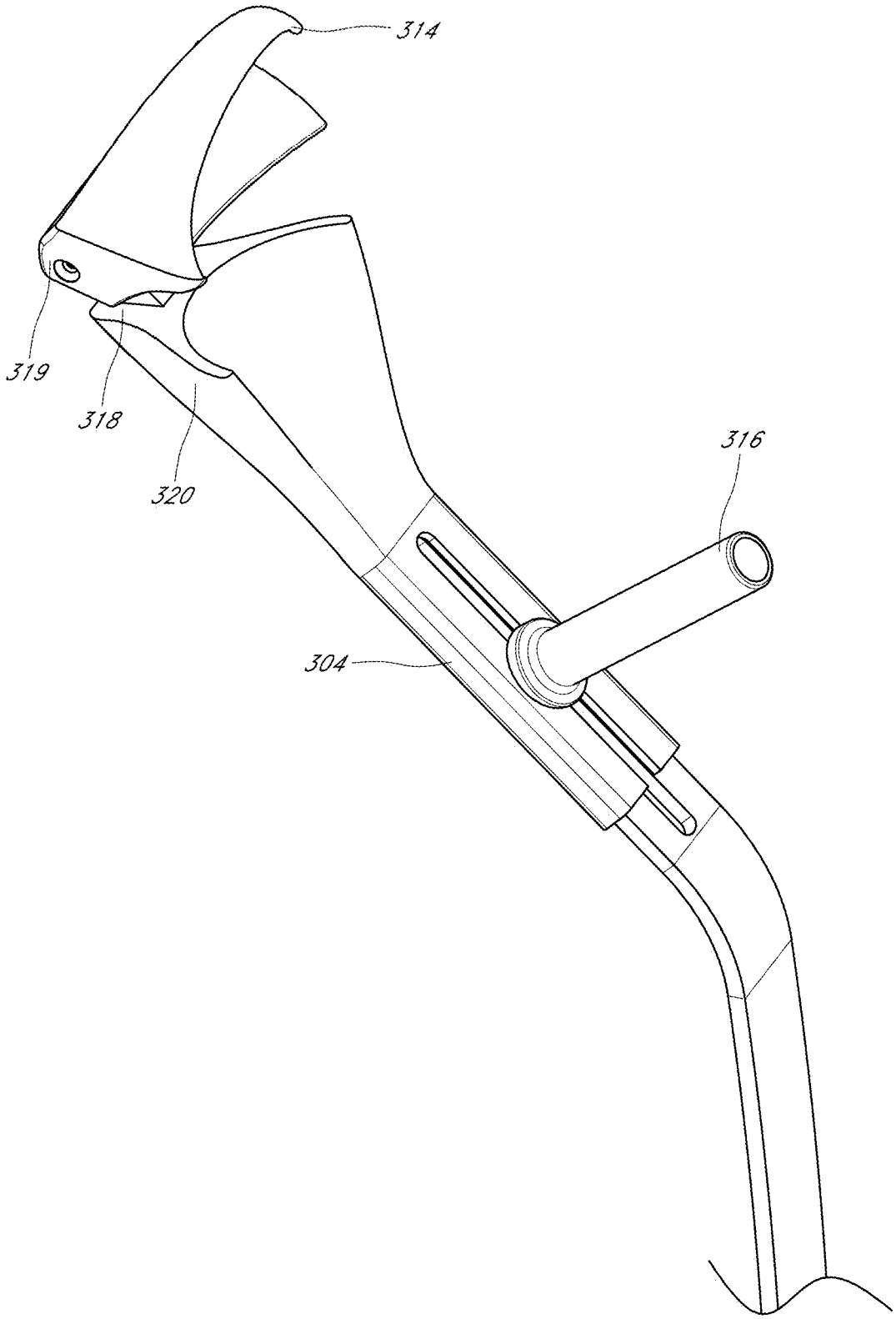
Figure 3D:
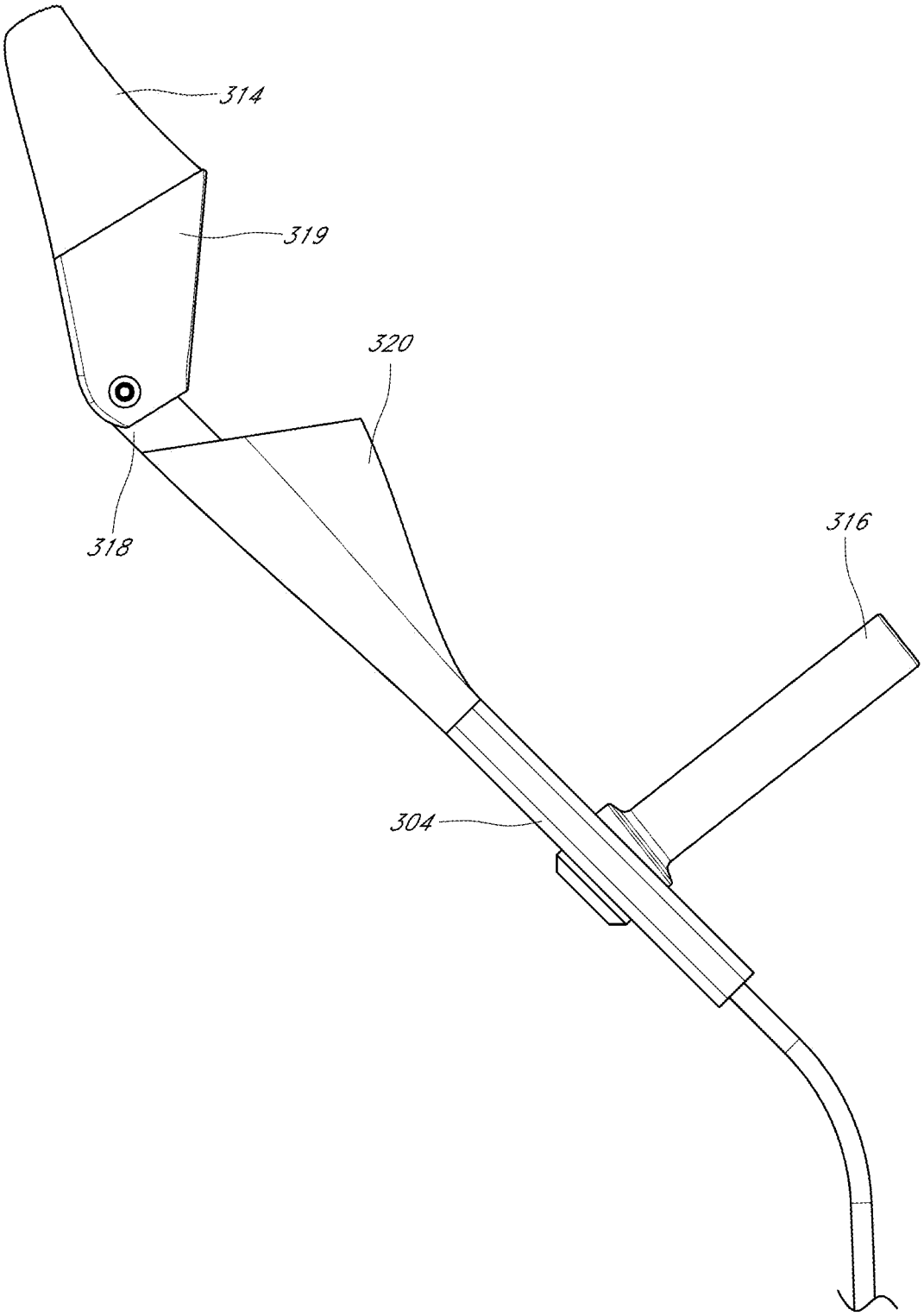

As a non-limiting example, if the user wishes to open a door, he or she can release the hand grip 316 and reach for the door handle. While traditional crutches might require the user to disengage from the crutch (whether or not it has an arm cuff), the hinge 318 advantageously allows the user to access the door handle while remaining attached to the crutch 300 via the arm cuff 314. FIGS. 3C and 3D illustrates the hinge 318 in use. For example, FIG. 3C illustrates the hinge 318 in a partially opened position while FIG. 3D illustrates the hinge 318 in a greater open position.

In some embodiments, the hinge 318 includes a spring (not shown) which biases the hinge 318 toward the closed position (see FIG. 3B), where the spring stretches as the hinge 318 opens and exerts an opposing force to return the hinge 318 to a neutral position (e.g., closed position). For example, bending the arm cuff to position the hinge 318 in an open configuration adds tension to the spring. The spring tension resists the open configuration and aids in returning the hinge 318 to a neutral position (e.g., closed position).

Figure 4A:
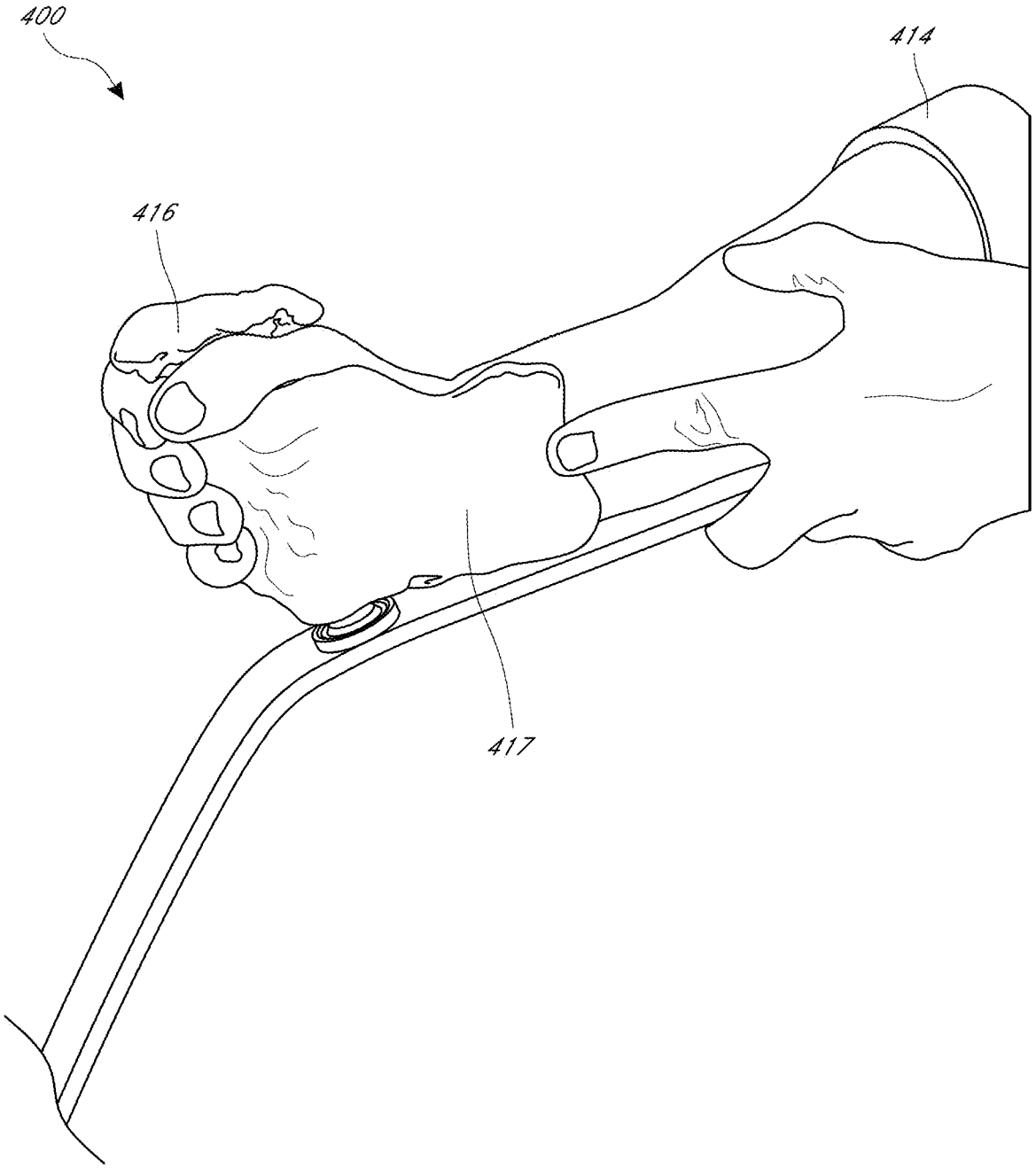
FIGS. 4A-4C illustrate partial views of a proximal portion of a crutch having a wrist stabilization feature, according to some embodiments.
Figure 4B:
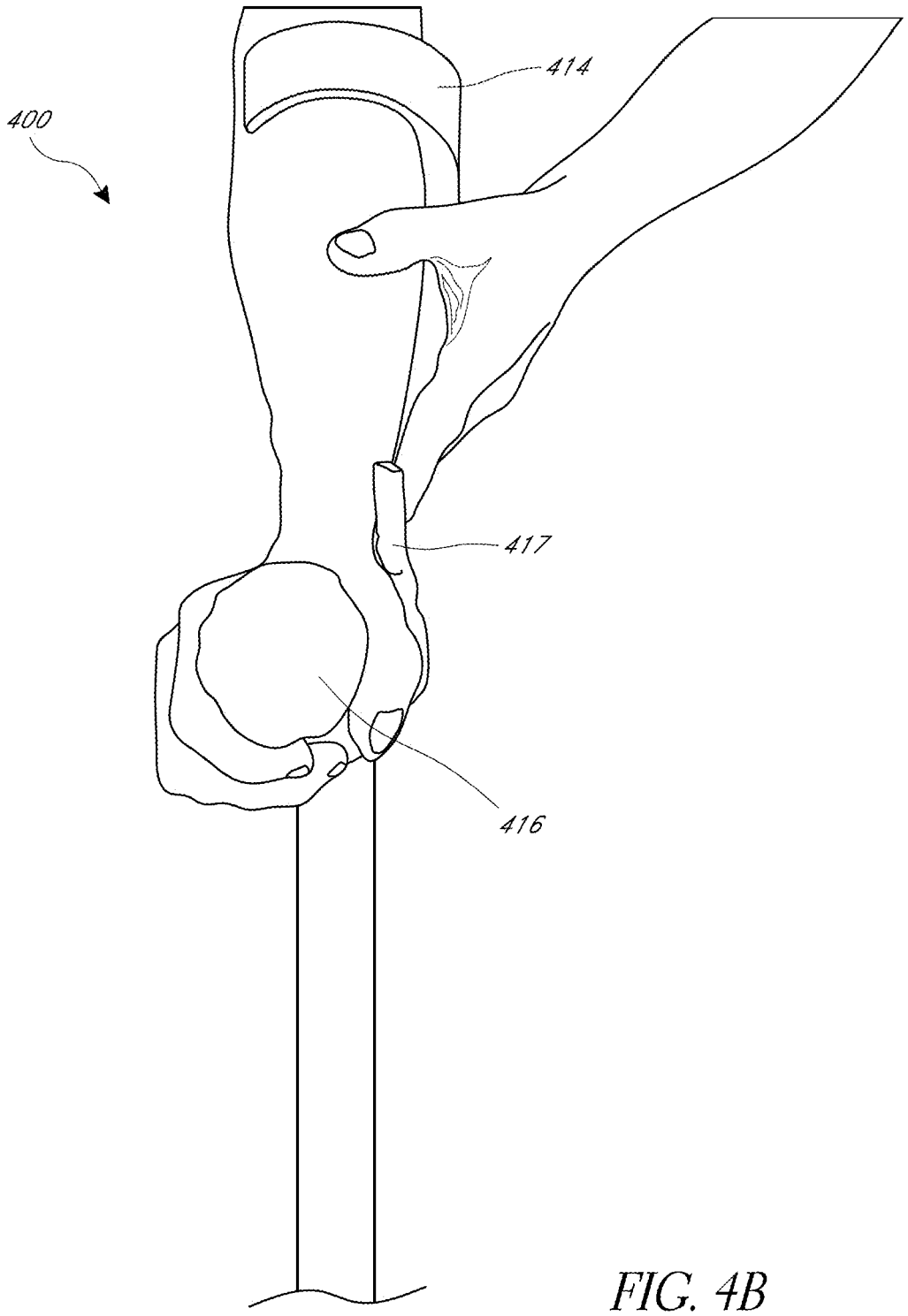
Figure 4C:
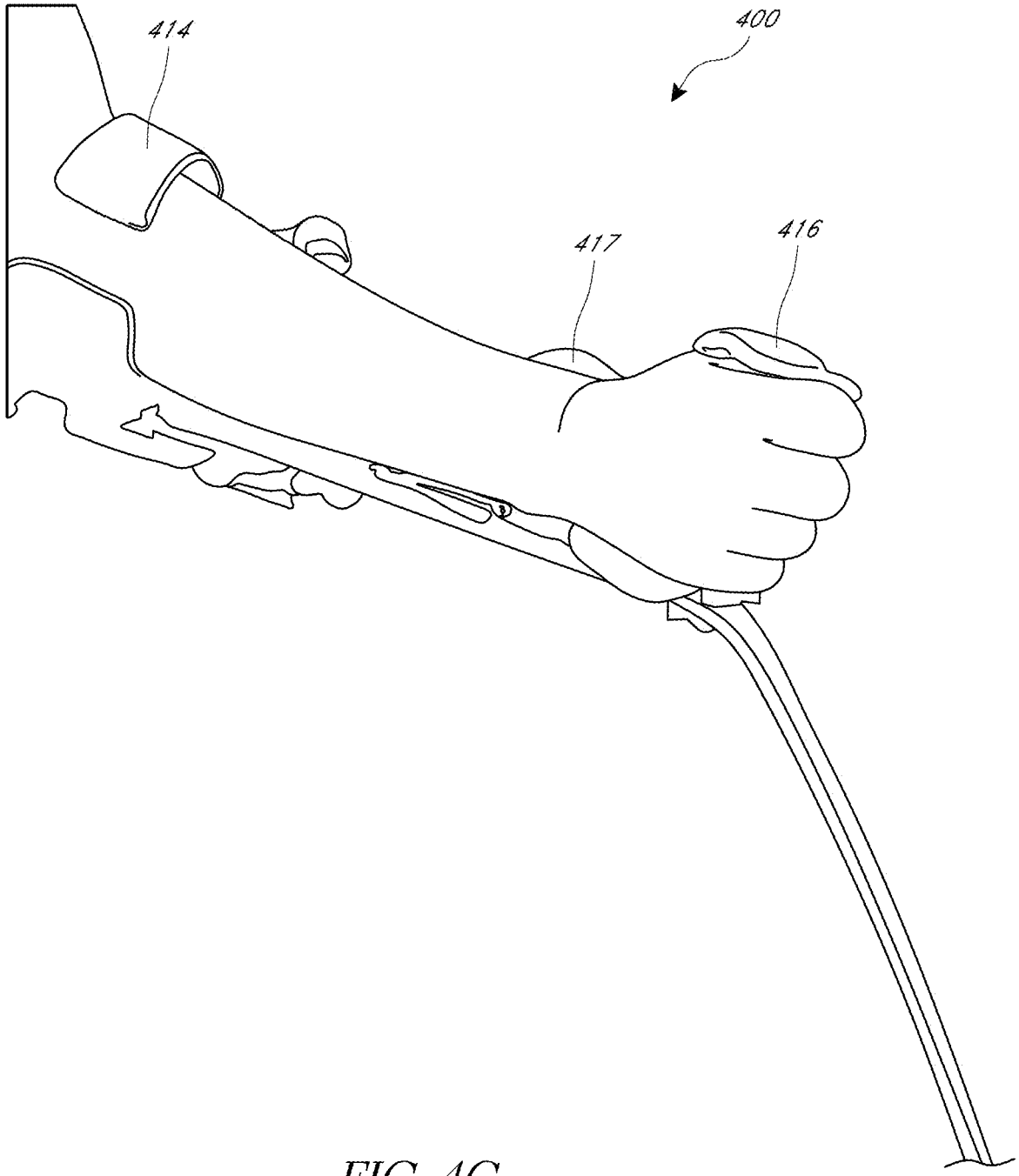

FIGS. 4A-4C illustrate a partial view of a crutch having a handle with a wrist support member, according to some embodiments. The wrist support member 417 reaches from the inside of the palm to a forearm of a user and provides an enveloping handle that advantageously reduces strain and fatigue on the wrist during use of the crutch. As compared to other crutches in which a user supports his weight by tightly grasping the handle (and thereby causing unwanted strain on the wrist), the wrist support member 417 advantageously supports the wrist with its surrounding structure. The inner side of the user's arm can rest on the wrist support member 417, thereby allowing the user's hand and wrist to be supported by the enveloping structure of the wrist support member 417. For example, the wrist support member 417 can be contoured to comfortably receive a palm of the user. In some embodiments, the wrist support member 417 includes a structure which can help retain the hand on the handle but will not restrict a user from removing his hand from the crutch. Advantageously, the wrist support member 417 allows the user to hold onto the crutch without having to grab or hold the handle tightly during use, thereby allowing the user to hold onto the crutch in a more relaxed manner, thereby reducing strain and fatigue on the user's hands during use of the crutch.

In some embodiments, the wrist support member 417 is optionally integrated with the handle 416 such that it is a single unitary piece (e.g., monolithic). Optionally, the wrist support member 417 and/or handle 416 is made of a resilient (e.g., flexible) material that resiliently supports the user's wrist. For example, the wrist support member 417 can include overmolded plastic, metal, carbon fiber, or composite material, to name a few. In addition or alternatively, the wrist support member 417 can include a flexible or soft outer shell which can include, for example, ethylene-vinyl acetate (EVA), silicone, or rubber. The wrist support member 417 can work in tandem with the arm cuff 414 to provide an enveloping system that advantageously reduces strain or fatigue on the wrist. For example, in some embodiments, the wrist support member 417 allows the user to hold onto the crutch without having to grab or hold the handle tightly during use, thereby allowing the user to hold onto the crutch in a more relaxed manner that helps reduce strain and fatigue on the user's hands during use of the crutch. Instead, support of the user's hand and wrist is provided by the surrounding structure of the arm cuff 414, wrist support member 417 and handle 416.

Figure 4D:
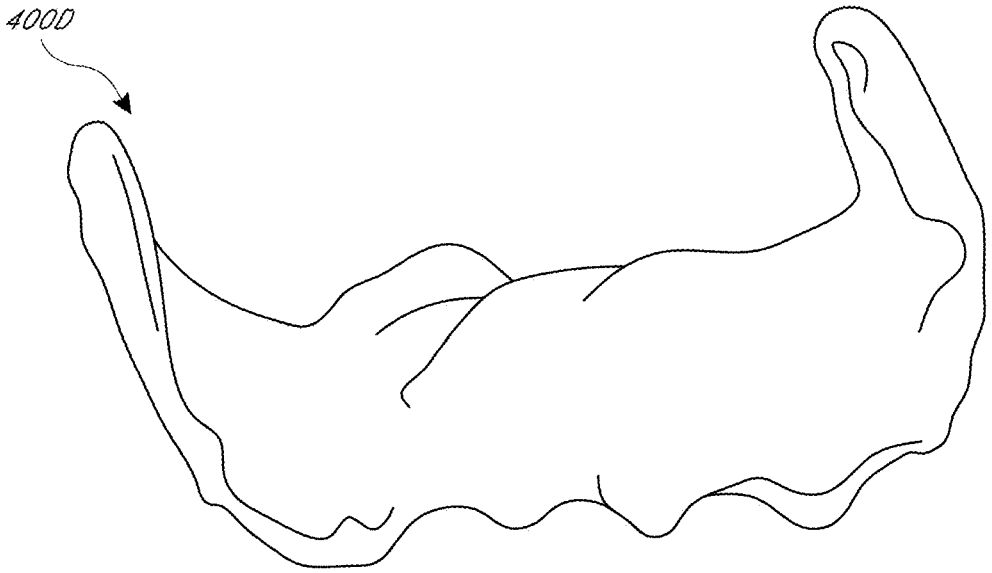
FIGS. 4D-4E illustrate hand grips of a crutch, according to some embodiments.
Figure 4E:
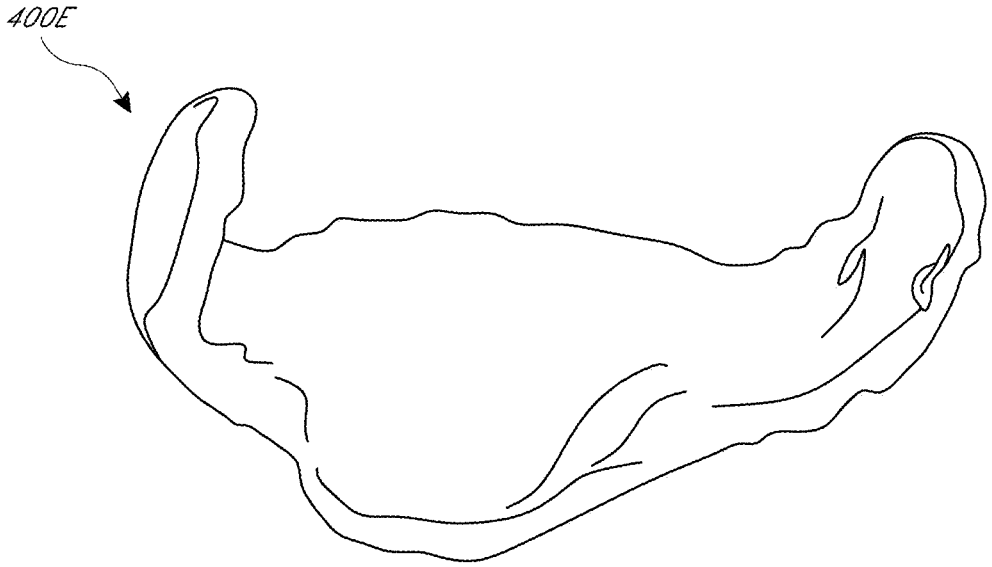

FIGS. 4D-4E illustrate optional hand grips that can be utilized with or without the wrist support member 417. As described herein, the hand grips 400D, 400E can be contoured to fit a hand of a user such that the hand grips 400D, 400E provide an anatomical fit of the user's hand. For example, the hand grips 400D, 400E can be contoured to fit a specific user's hand or can be contoured to fit the hand of a generic user (e.g., can have a palm engaging surface and finger engaging surfaces). Although the hand grips 400D, 400E are illustrated without a corresponding wrist support, it should be noted that any of the hand grips described herein can be configured with wrist supports.

Figure 5:
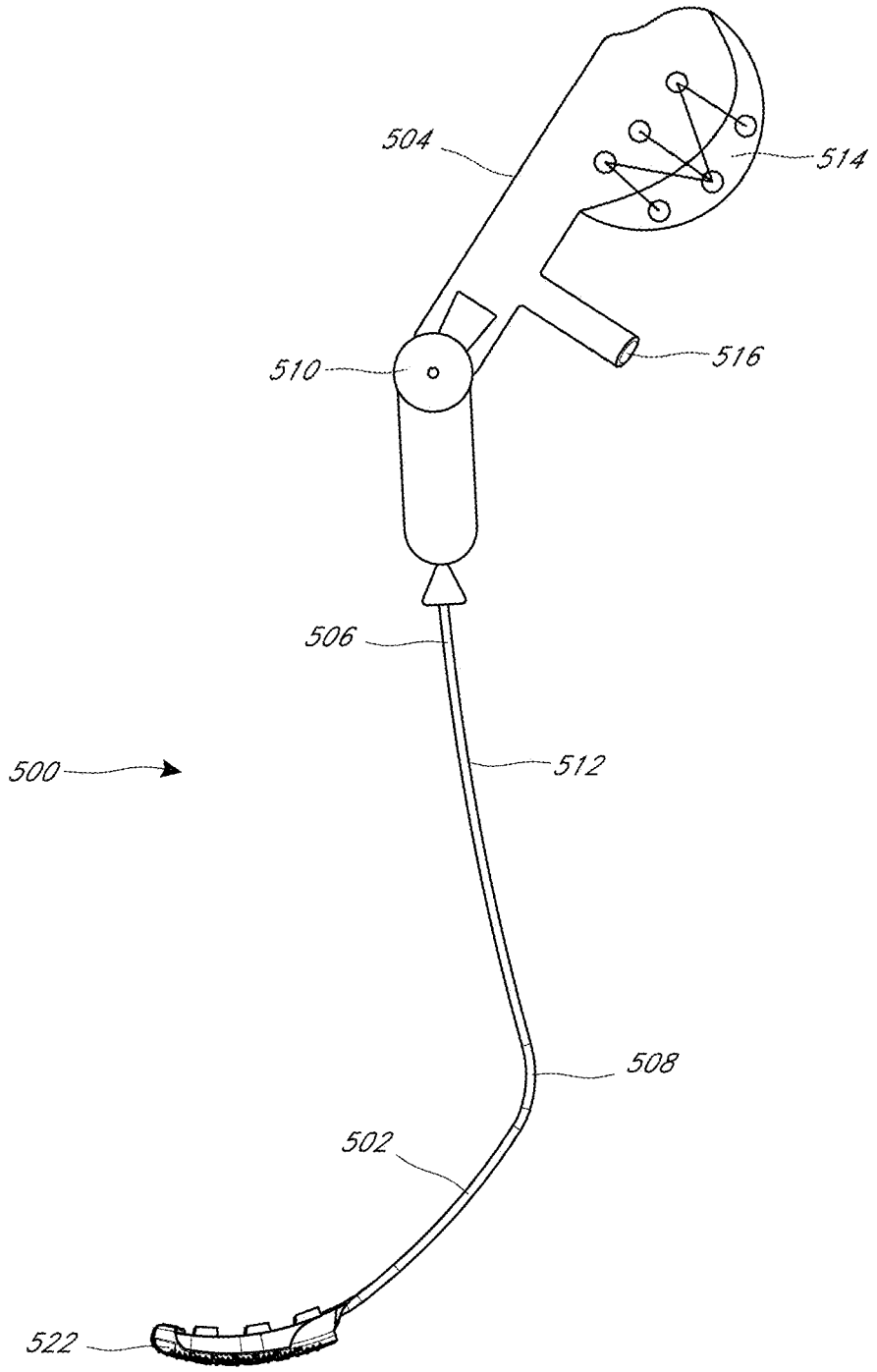
FIG. 5 illustrates a crutch configured to provide energy storage and return to a user during ambulation, according to some embodiments.

FIG. 5 illustrates a crutch 500 that can provide energy storage and return to a user during ambulation, according to some embodiments. The crutch 500 includes an elongate member 502, an arm cuff 514, a hand grip 516, a sole 522, a joint 510, and an actuator 536. The elongate member 502 includes a proximal portion 504, a central portion 506, and a curved distal portion 508. The elongate member 202 includes a first transition section 210 having a joint 510.

The joint 510 is connected such that the angle between the central portion 506 and the proximate portion 504 can be adjusted, thereby providing a comfortable angle for a variety of users with difference preferences or of different heights, arm lengths, etc. In some embodiments, such as illustrated in FIG. 5, the joint 510 can be a mechanical joint. A mechanical joint can be spring loaded or a damped actuator 536 that, for example, rotates the proximal portion 504 about the joint 510 relative to the central portion 506 in response to a load on the crutch 500 (e.g., when the crutch contacts a walking surface). In examples such as these, a spring or damper can control the rotation of the proximal portion 504 such as the degree of rotation, speed of rotation, etc. In other embodiments, the joint can be a powered joint. For example, a powered joint can have an electric motor that rotates the proximal portion 504 relative to the central portion 506 about the joint 510.

The central portion of the elongate member can be relatively long in length (such as seen in FIG. 2A) or relatively short in length (such as seen in FIG. 5). For instance, the length of the central portion can constitute about ¾, ⅔, ½, ⅓, ¼, or ⅛ the length of the crutch. The central portion can be almost entirely straight or can have a moderate or substantial curve or bend. For instance, the central portion can have a relatively high radius of curvature, such that there is very low curvature, or a moderately low radius of curvature, such that there is moderately high curvature.

Figure 6:
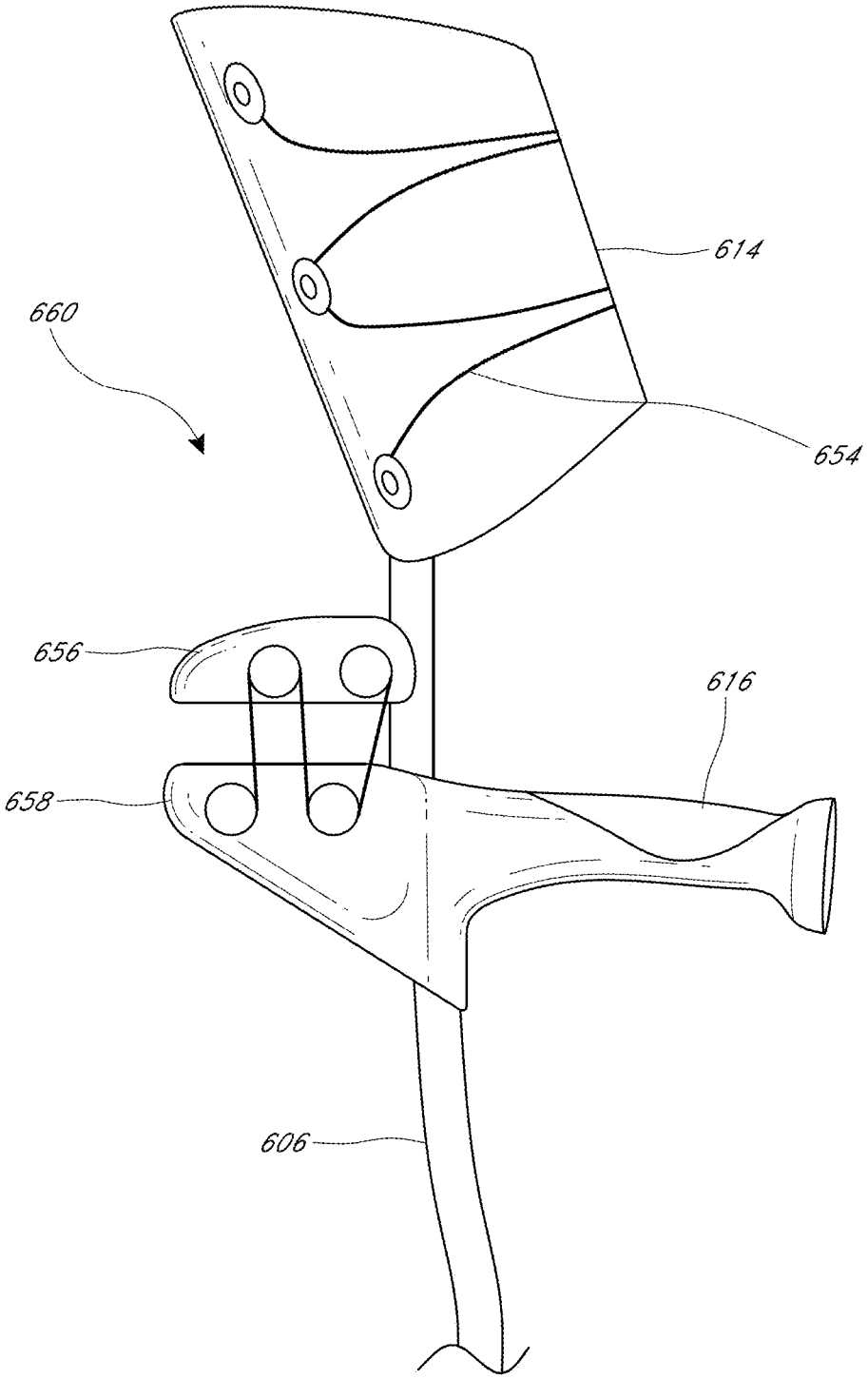
FIG. 6 illustrates a partial view of a proximal portion of a crutch configured to provide energy storage and return to a user during ambulation, according to some embodiments.

FIG. 6 illustrates a partial view of a proximal portion of a crutch that can provide energy storage and return to a user during ambulation, according to some embodiments. In this example, the proximal portion includes a pulley system 660 to increase user stability during ambulation. The pulley system 660 includes an arm cuff 614, a lower section 658, an upper section 656, and a cable 654 wound throughout the pulley system such that the cable 654 can be tightened to increase the pressure of arm cuff 614 on a user's arm. For example, responsive to a load on the crutch (i.e., a force applied by the user's weight on the hand grip 616), the hand grip 616 and the lower portion 618 of the pulley system 660 slide down the central portion of the crutch, thereby increasing the distance between the lower portion 658 and upper portion 656 and causing the cable 645 to tighten the arm cuff 614 around the user's arm. Responsive to a removal of the load on the crutch, the lower portion 658 returns to an unloaded position (i.e., the lower portions moves closer to the upper portion 656) and the cable is loosened such that the pressure of the arm cuff 615 on the user's arm is reduced. Thus, the pulley system can tighten the arm cuff 614 around the arm as the user applies force to the crutch and can release the tension of the arm cuff 614 as the user removes force from the crutch.

In some examples, the cuff fit (i.e., the tension of the cuff on the user's arm) can be adjusted by the user and locked to retain the chosen cuff fit until the user chooses to release the tension (i.e., unlock the pulley system 660) on the arm cuff 614. For example, the user can load the crutch (i.e., apply a force to the hand grip 615) and adjust the cuff fit based on an amount of applied load. Once a desired cuff fit is achieved, the user can lock the cuff fit (e.g., press a button to lock the pulley system 660). In examples such as these, the arm cuff 614 retains the selected cuff fit until the pulley system 660 is unlocked (e.g., the user presses a button to release the pulley system 660). In some examples, the pulley system 660 includes a spring that can act as a shock absorber, which can provide additional storage and release of energy during ambulation.

Hollow Elongate Member

Figure 7:
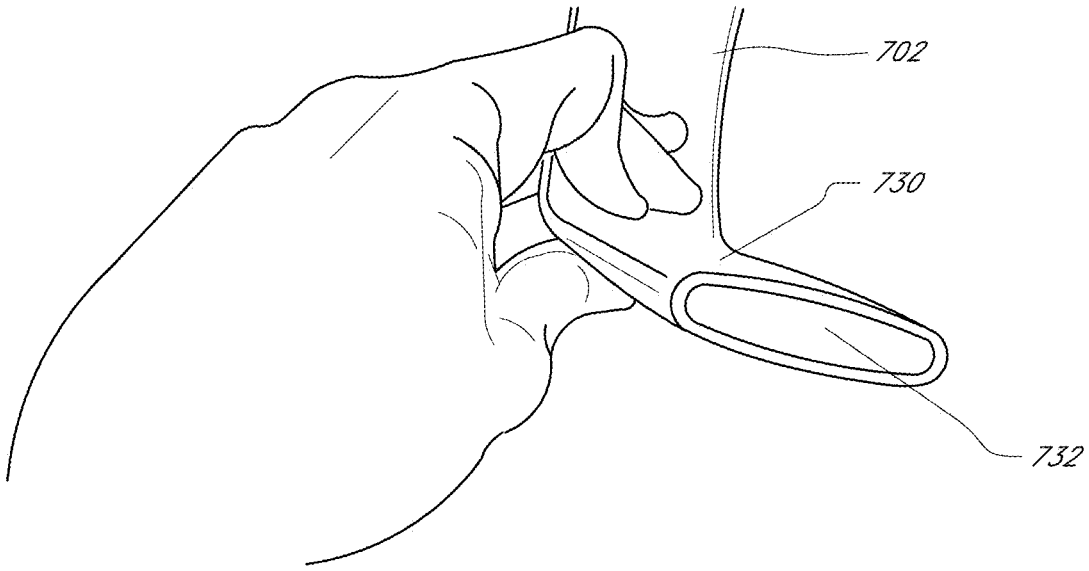
FIG. 7 illustrates a hollow crutch configured to provide energy storage and return to a user during ambulation, according to some embodiments.

FIG. 7 illustrates an example embodiment of a hollow elongate member 702, according to some embodiments, which can be incorporated in one or more locations on a crutch, such as the crutches described above. In some embodiments, the proximal, central and/or distal sections of the crutch can be defined by the hollow elongate member 702 structure. The hollow elongate member 702 has a body 730 surrounding an interior cavity or core 732. The hollow elongate member 702 can advantageously have a lighter weight than a solid member in conventional crutches, which can help improve ease of use and/or performance. In some embodiments, the body 730 of the hollow elongate member 702 is seamless. The hollow elongate member 702 can be open or capped at one or both ends. Various types and configurations of caps and the degree to which the cap(s) extends into the cavity 732 can be selected to tune the flexibility and/or strength properties of the elongate member 702.

In some embodiments, the elongate member 702 has a symmetrical, substantially blade or oval shaped cross-section. Alternatively, the elongate member 802 can have an aerodynamic cross-section, such as an ellipse or airfoil. The cross sectional shape of the hollow elongate member 802 and internal characteristics of the elongate member 802 can be varied and selected to tune the flexibility and/or strength properties of the crutch.

In some embodiments, a crutch can have beneficial stiffness characteristics during use. The stiffness or flexibility of the crutch can be tuned or adjusted by, for example, varying the cross-sectional shape of the hollow elongate member 702 (e.g., via an adjustable member attached to the elongate member 702 that can be actuated, such as by the user).

In some embodiments, the crutch (e.g., the crutch 100-500, 1100-1500 disclosed herein) has adjustable stiffness and flexibility characteristics that advantageously allows the stiffness of the crutch to be adjusted (e.g., by the user). Optionally, the crutch can include a variable stiffness adjustment member that can be actuated by the user to adjust a stiffness of at least a portion of the crutch. For example, in some embodiments, the distal portion (e.g., distal portion 108 in FIG. 1) of the crutch includes an elongate foot element extending from a proximal end to a toe end. The foot element includes a tongue portion defined by a generally U-shaped cutout in the foot element. The tongue portion is configured to flex at least partially independently of a remainder of the foot element. The prosthetic foot further includes a mechanism (e.g., lever, tab) that can be selectively actuated to operatively connect or operatively disconnect the tongue portion from the remainder of the foot element. When the tongue portion is operatively connected to the remainder of the foot element, the foot element exhibits relatively greater stiffness, and when the tongue portion is operatively disconnected from the remainder of the foot element, the foot element exhibits relatively lower stiffness. In addition, the crutch can include other adjustable stiffness and flexibility characteristics, such as those described in U.S. patent application Ser. No. 14/858,693, filed Sep. 18, 2015 and entitled VARIABLE STIFFNESS PROSTHETIC FOOT, hereby incorporated by reference in its entirety.

When a solid, curved distal member made of a carbon fiber or similar material is bent during use, the top and bottom surfaces try to deform, or compress and stretch, respectively. This deformation is resisted by the mechanical properties of the fiber, and the crutch has a strong resistance to collapsing in the center. The resistance increases as the deformation or stretching and compressing forces increase, such that the stiffness of the crutch increases linearly as the curved distal member bends.

In contrast, a hollow elongate member 702 having an ovular cross-sectional shape, such as the hollow elongate member 702, is allowed to deform or collapse during use to compensate for the stretching and compressing forces. The top and bottom surfaces of the elongate member come together, decreasing the thickness of the interior cavity or core 732. This elongate member therefore has less resistance to bending than a solid elongate member, making the crutch more elastic or springier.

The ovular hollow elongate member 802 can also exhibit non-linear deformation during use. For example, as the bending increases, the resistance to bending decreases and as the crutch is allowed to return to its resting state, the restorative energy increases in a non-linear fashion. This advantageously provides greater energy return during a toe-off portion of the gait cycle as the crutch returns to its original shape. In other embodiments, if a hollow elongate member is instead made with a tear-drop or circular cross-sectional shape, the crutch can exhibit increased resistance to bending or flexing compared to both an ovular hollow elongate member and a solid elongate member.

The cavity 732 of the hollow elongate member can be partially or completely filled with various materials (e.g., one or more fluids, gasses, polymers, silicones, or other media). This can allow for adjustable pressure, flexibility, weight, and/or other structural characteristics. For example, in one embodiment, the cavity 732 can be partially or completely filled with a gas such as helium to reduce the overall weight of the crutch. In some embodiments, the cavity 732 is separated into two or more chambers, which may or may not be fluidly connected to one another. For example, the chambers can be fluidly connected via valves that are controllable to regulate flow between chambers and/or the pressure within the chambers. Different chambers can be unfilled or can be partially or completely filled with the same or different media. The fluid or media can be disposed directly within the cavity 732 or chambers or can be housed in, for example, one or more bladders disposed within the cavity 732 or chambers.

In some embodiments, the cavity 832 or chambers can include one or more shock-responsive polymers. The shock-responsive polymer(s) can exhibit increased stiffness under shock load. For example, when the user initially applies a force to the crutch, such as at the start of ambulation, the shock-responsive polymer(s) allows the crutch to bend and provides increased springiness (e.g., energy return) at push-off.

Figure 8:
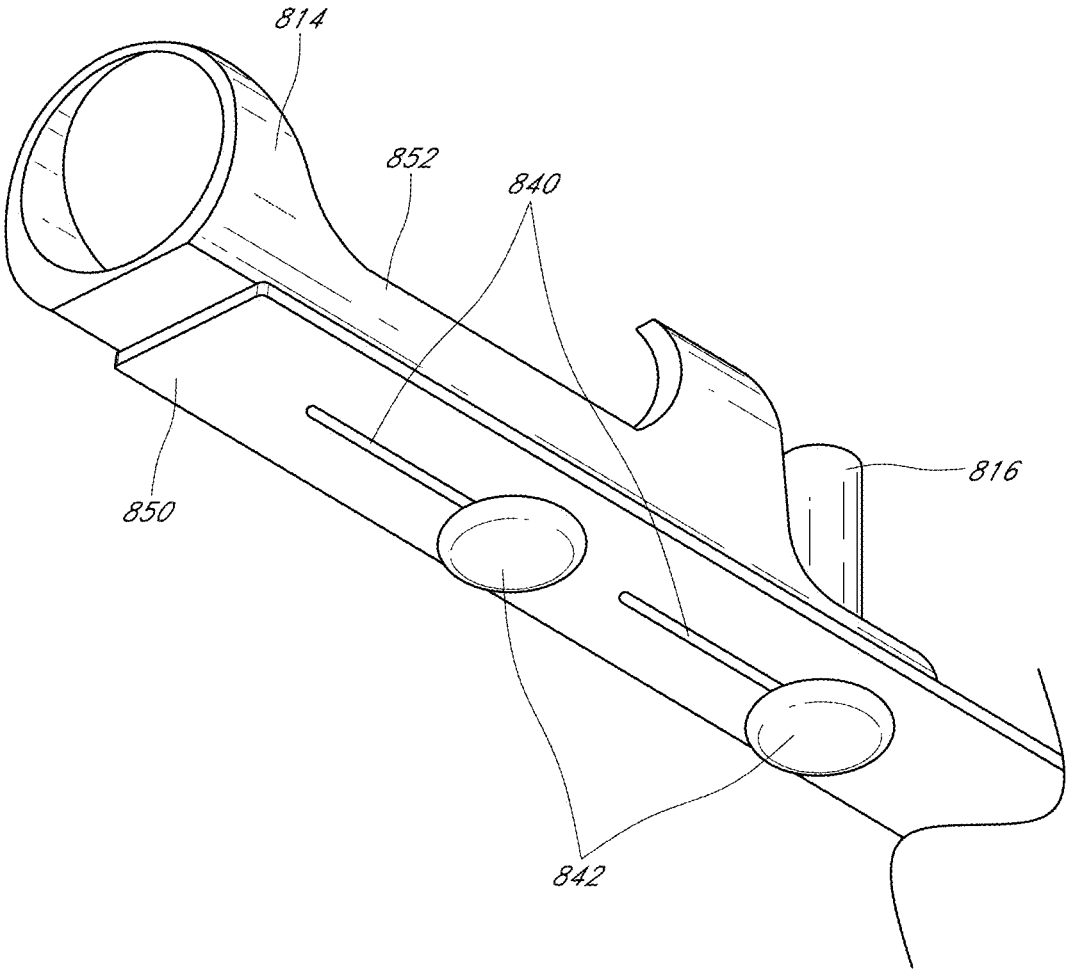
FIG. 8 illustrates a proximal portion of a crutch configured to provide energy storage and return to a user during ambulation, according to some embodiments.

FIG. 8 illustrates a proximal portion of a crutch that can provide energy storage and return to a user during ambulation, according to some embodiments. In this example, the proximal portion can be adjusted to shorten or lengthen the crutch, thereby providing height adjustment options to an intended user. The proximal portion includes a slidable portion 852 slidably attached to a stationary portion 850. The stationary portion 850 can be the proximal portion of the crutch, such as the proximal portion 104 of the elongate member 102 described above. The slidable portion 852 can be an integrally formed unit (e.g., monolithic or seamless unit) that defines an arm cuff 814 and handle 816 via which the user can hold onto the crutch. The slidable portion 852 includes prongs or protrusions (not shown) disposed within slots 840 of the stationary portion 850 such that the protrusions have a limited range of motion within the slots 840.

As illustrated, the slidable portion 852 can optionally include a member 842 distally attached to each protrusion to movably couple the slidable portion 852 to the stationary portion 850. The member 842 can optionally be disk-shaped or have any other suitable shape. In some examples, it is preferred that the member 842 is larger than the slot 840 to ensure the slidable portion 852 does not detach from the stationary portion 850.

In some examples, the protrusion and disk-shaped member can be a bolt that can be screwed to or unscrewed from the slidable portion 852 to lock or unlock the slidable portion 852 from the stationary portion 850. For example, a user can adjust the height of the crutch by loosening the one or more bolts disposed within the one or more slots of the stationary portion, sliding the slidable portion along the slots of the stationary portion until the user is satisfied with the height of the crutch, and tightening the one or more bolts such that the position of the slidable portion is locked on the stationary portion.

One of ordinary skill in the art would appreciate the vast number of ways in which the height of the crutch can be adjusted. For instance, in some examples, the central portion (e.g., central portion 106 in FIG. 1) or the distal portion (e.g., distal portion 108 in FIG. 1) of the crutch can be adjusted in addition to or instead of the proximal portion (e.g., proximal portion 104 in FIG. 1).

Figure 9:
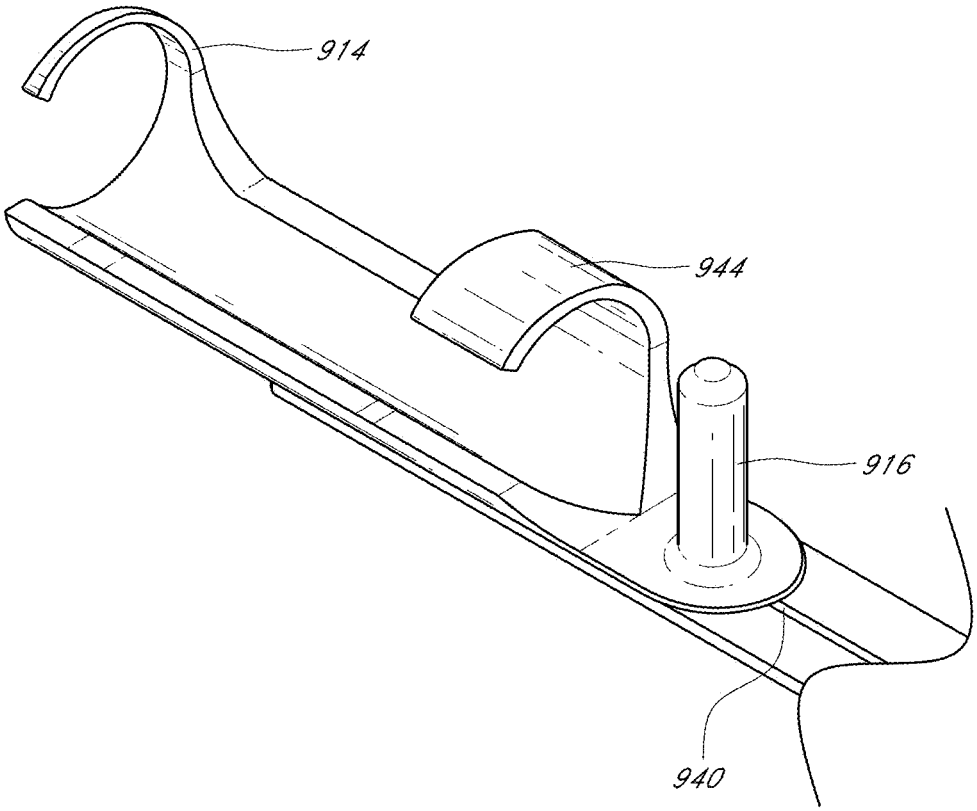
FIG. 9 illustrates a proximal portion of a crutch configured to provide energy storage and return to a user during ambulation, according, to some embodiments.

FIG. 9 illustrates a proximal portion of a crutch that can provide energy storage and return to a user during ambulation, according to some embodiments. In this example, the proximal portion of the crutch includes a forearm cuff 914, a wrist cuff 944, and a hand grip 916. As shown, the forearm cuff 914 and wrist cuff 944 can have a half or partial ring shape that enables a user to slide his arm into the crutch from the side, thereby advantageously reducing the amount of time required to begin using the crutch. In other examples, the wrist cuff 944 and/or the forearm cuff 914 can have a full ring shape (see e.g., FIGS. 8 and 10).

The wrist cuff 944 can provide support medially and/or to the top of a user's wrist. The wrist cuff 944 can also provide support to the user's hand, thereby preventing the wrist from moving from side to side or sliding forward on the hand grip 916. In some examples, the design of the wrist cuff 944 enables to a user to slide a flat wrist under the wrist cuff 944 and rotate their arm (e.g., about 90 degrees) to allow them to grab the hand grip 916. Optionally, the wrist cuff 944, handle 916 and forearm cuff 914 can be part of a single unitary (e.g., monolithic or seamless) piece that can couple to a proximal end of the crutch body. Optionally, the unitary piece can slidably couple to the proximal end of the crutch body in a similar manner as described above in connection with FIG. 8.

Figure 10:
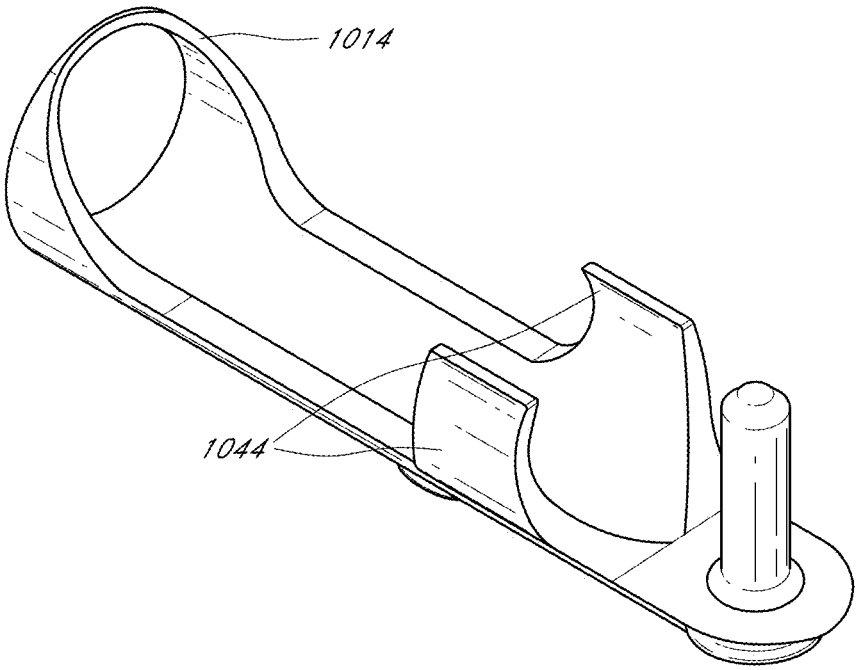
FIG. 10 illustrates a proximal portion of a crutch configured to provide energy storage and return to a user during ambulation, according to some embodiments.

FIG. 10 illustrates a proximal portion of a crutch that can provide energy storage and return to a user during ambulation, according to some embodiments. In this example, the proximal portion of the crutch includes a completely enclosed forearm cuff 1014 (i.e., a full ring shape) and a partially enclosed wrist cuff 1044 (i.e., a partial or half ring shape). This design provides a user with upper forearm and wrist support while advantageously allowing a user to remove his hand from the crutch yet remaining attached to the crutch via the forearm cuff 1014. For example, the user can remove his hand from the crutch (e.g., to talk on the phone or shake hands) without having to drop the crutch or hold the crutch with the user's other hand.

In some examples, the half ring wrist cuff 1044 can be fixed to the body of the crutch. In other examples, the half ring wrist cuff 1044 can be configured to rotate. In some examples, a rotating half ring wrist cuff provides as much support as a full ring wrist cuff and additionally provides the detaching capabilities as mentioned above.

Figure 11:
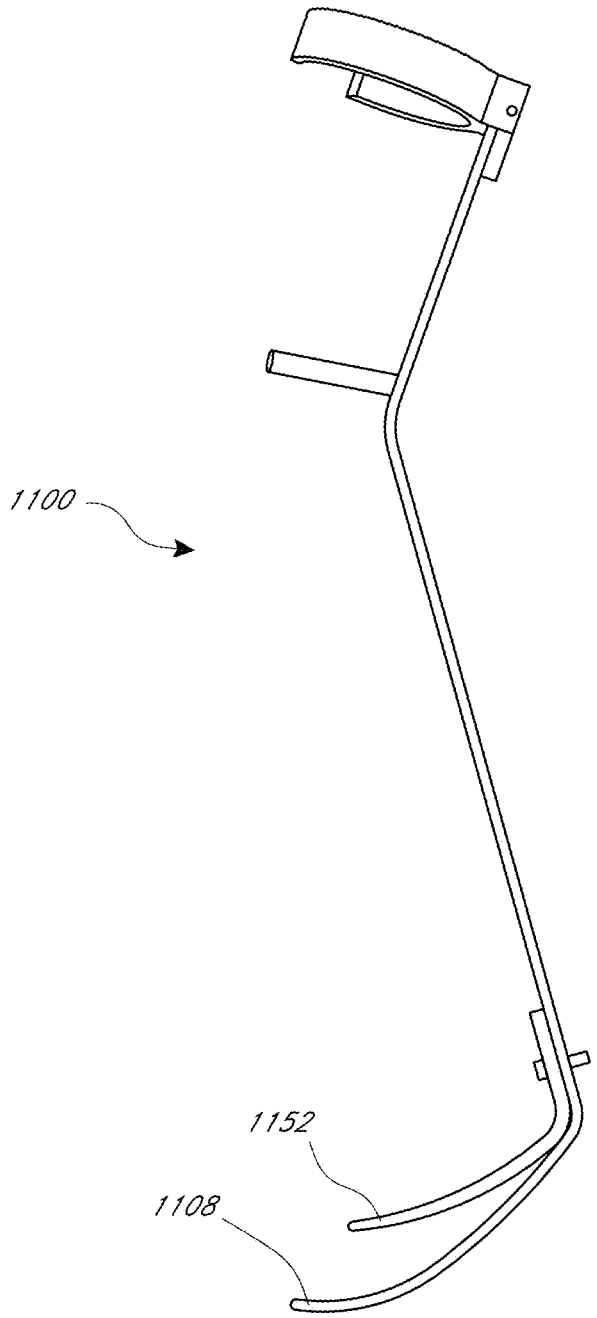
FIG. 11 illustrates a crutch configured to provide energy storage and return to a user during ambulation, according to some embodiments.

FIG. 11 illustrates a crutch that can provide energy storage and return to a user during ambulation, according to some embodiments. The crutch 1100 is similar to the crutch 100 in FIG. 1, except as described below. As shown in FIG. 11, the crutch 1100 includes a second blade 1152 removably attached to the crutch 1100 to provide additional support and/or progressive stiffness during use.

As shown, the second blade 1152 can be positioned above the first blade 1108 such that the second blade does not make contact with a walking surface. Instead, the second blade can be activated (i.e., provide additional stiffness and support to the crutch) during heavy or extreme use. For instance, during normal ambulation, a user may only activate the first blade 1108 because the force applied by a user's weight during ambulation is not great enough to activate the second blade 1152 (i.e., the force is not great enough to flex the first blade 1108 into contact with the second blade 1152). In contrast, if a user increases his speed or activity level, the second blade 1152 can be activated (e.g., flexed) due to the increased force applied by the user to the crutch. For example, as the user's force on the crutch increases, the first blade 1108 will flex so that it contacts the second blade 1152, thereby activating (e.g., flexing) the second blade 1152. Flexing of the two blades 1108, 1152 increases the stiffness of the crutch 100 (as compared to the stiffness provided solely by flexion of the first blade 1108). Advantageously, the stiffness of the crutch progressively increases with an increase in the force applied to the crutch by the user (e.g., due to the engagement of the second blade 1152), thereby providing variable stiffness that adjusts with the level of force (e.g., level of exertion or activity level) applied by the user on the crutch 1100.

Figure 12:
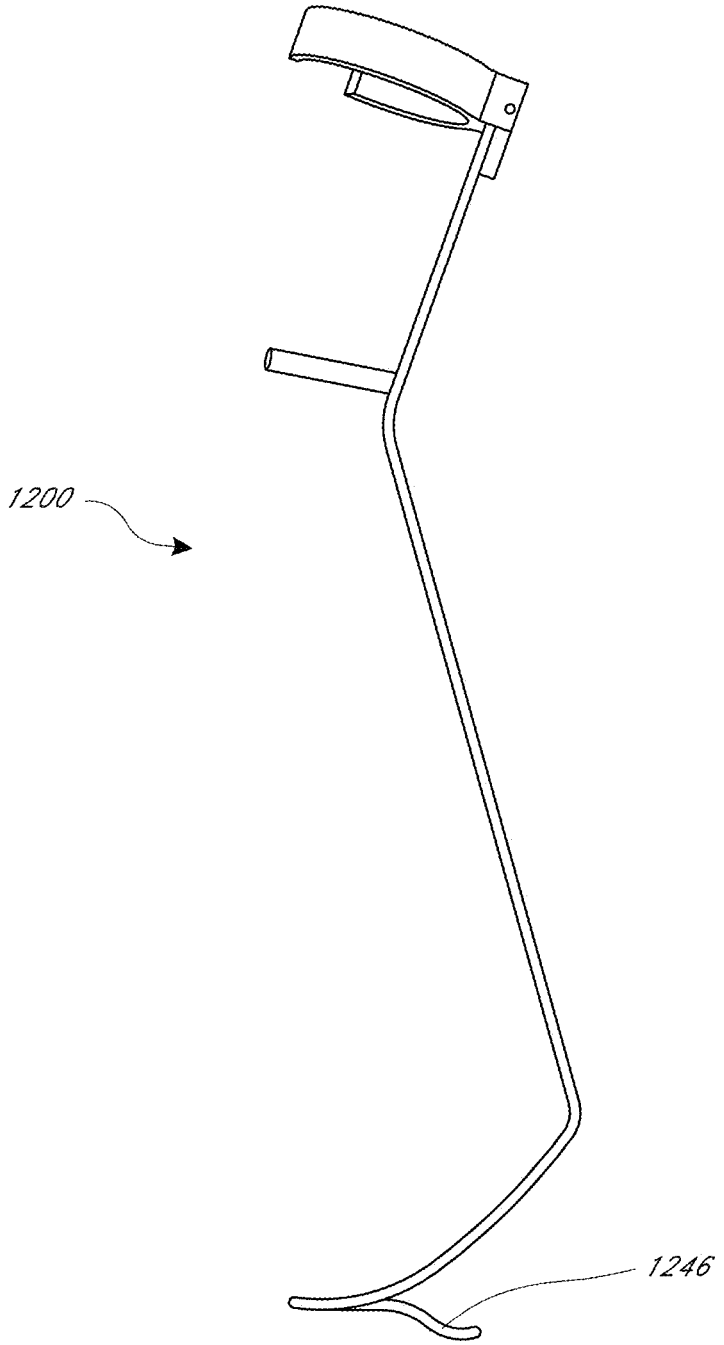
FIG. 12 illustrate a crutch configured to provide energy storage and return to a user during ambulation, according to some embodiments.

FIG. 12 illustrates a crutch 1200 having a heel blade 1246 attached to a curved distal portion (such as the distal portion 108 in FIG. 1), the heel blade 1246 providing increased energy storage and return to a user during ambulation. As described above with respect to energy storage and return of the crutch, vertical forces generated at heel contact are stored and translated into a linear motion. Energy is gradually released from the heel blade 1246 providing optimal return for forward progression of the user. In some examples, the heel blade 1246 can optimize walking/crutching efficiency thus reducing fatigue for the user. Additionally, the heel blade 1246 can advantageously facilitate rollover during ambulation by moving the user to midstance following heel strike of the crutch 1200.

The heel blade 1246 can be distally attached to the elongate member and attached to the curved distal portion (such as distal portion 108 in FIG. 1) of the crutch 1200 such that the curved distal portion does not make contact with the walking surface during ambulation. In examples such as these, a sole (such as the one described in reference to FIGS. 3A-B) can be attached to the heel blade.

In some examples, the curve distal portion extends past the heel blade 1246 such that both the curved distal portion and the heel blade 1246 contact with the walking surface during ambulation. In these instances, one or more soles can be attached to the curved distal portion and the heel blade 1246.

Figure 13:
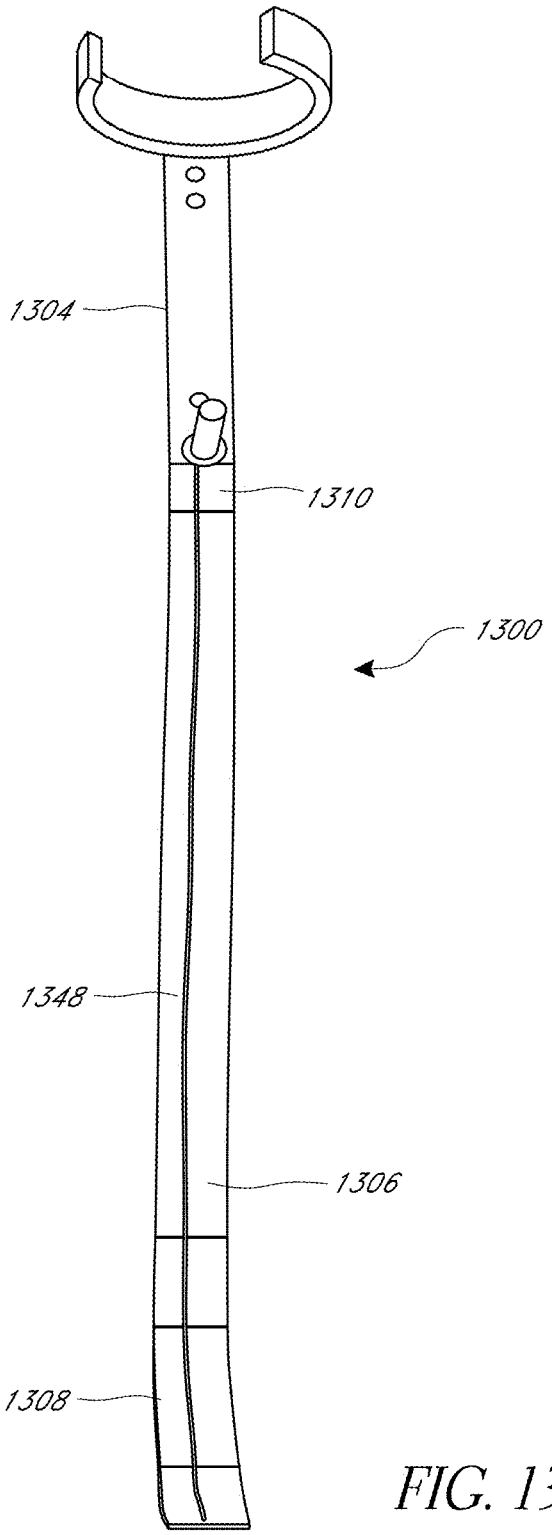
FIG. 13 illustrates a crutch configured to provide energy storage and return to a user during ambulation, according to some embodiments.
Figure 14:
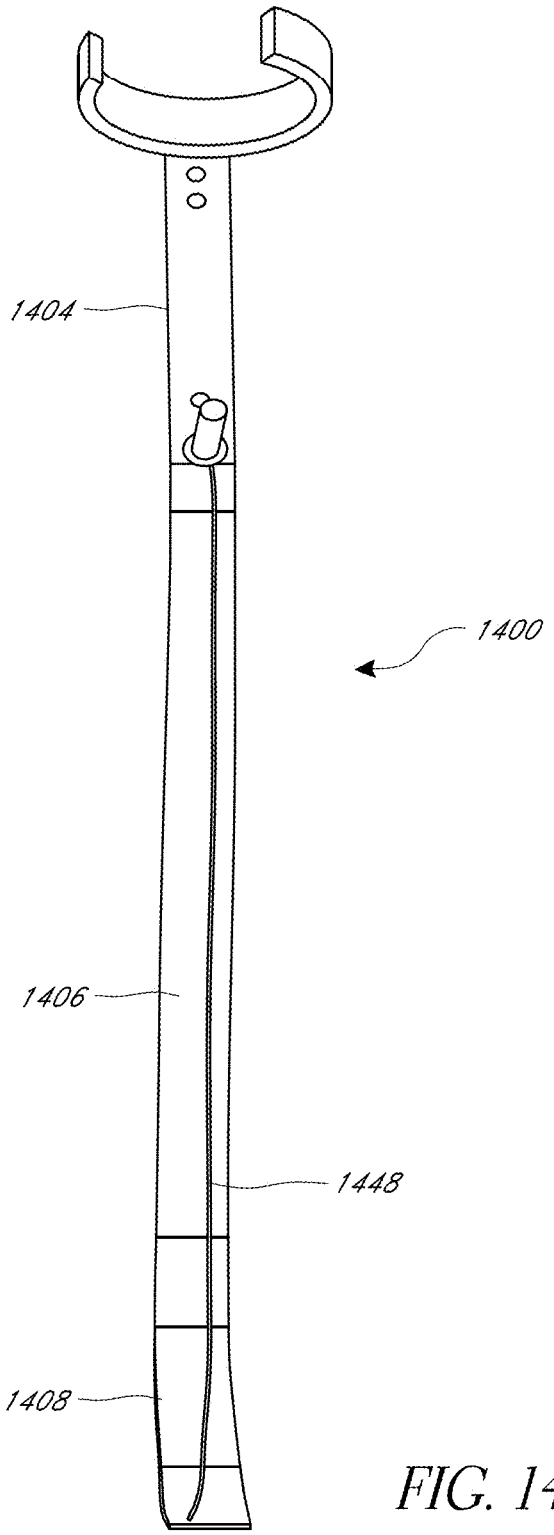
FIG. 14 illustrates a crutch configured to provide energy storage and return to a user during ambulation, according to some embodiments.

FIGS. 13 and 14 illustrate crutches having functional cuts (e.g., splits) in the crutch body to change the torsional movement of the crutch. For example, FIG. 13 depicts a crutch 1300 having straight cuts (e.g., a longitudinal slit) 1348 extending from the first transition section 1310 distal of the proximal section 1304, through the central section 1306 to the end of the curved distal portion 1308. The straight cuts or longitudinal slit 1348 can at least partially separate the crutch body into two or more blades that advantageously allow for multiaxial movement of the crutch 1300 and/or allow for operation on uneven surfaces (e.g., where one blade portion of the crutch body contacts a rock or uneven surface while the adjacent blade portion contacts a relatively even surface).

FIG. 14 depicts a crutch 1400 having curved cuts or slits 1448 extending from the first transition section 1410 distal of the proximal section 1404, through the central section 1406 to the end of the curved distal portion 1408. The curved cuts or splits 1448 allow for rotation of the crutch 1300 and/or can facilitate rollover of the crutch during ambulation.

Figure 15:
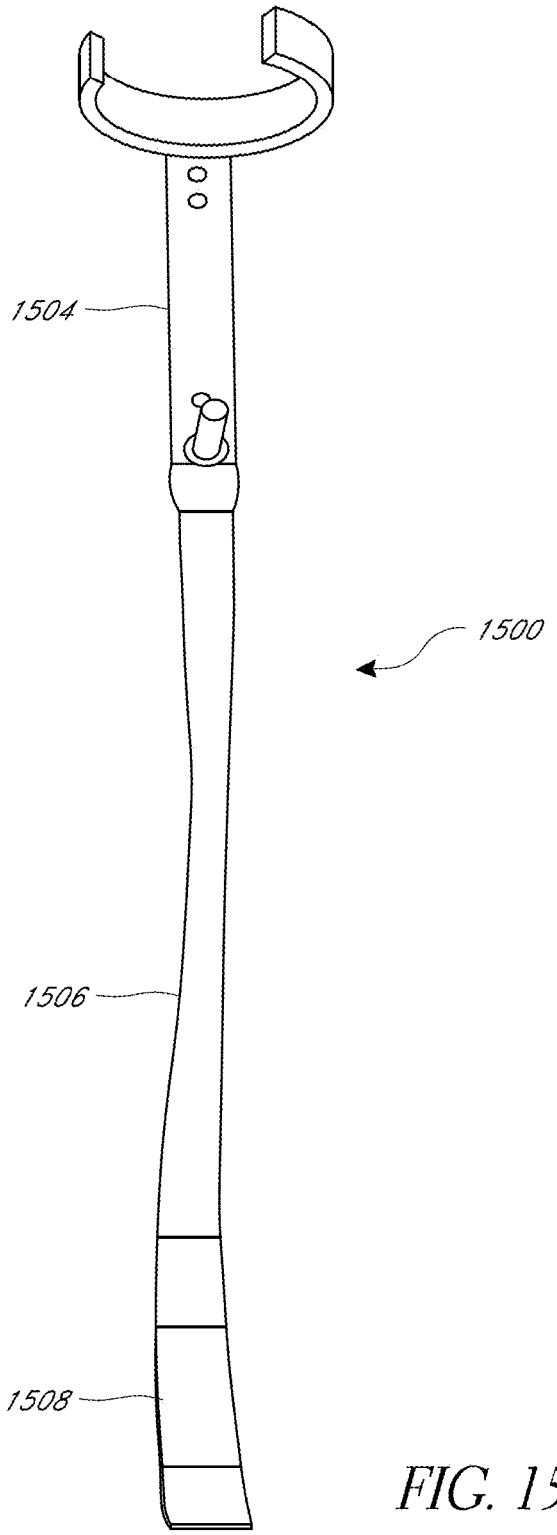
FIG. 15 illustrates a crutch configured to provide energy storage and return to a user during ambulation, according to some embodiments.
Figure 16A:
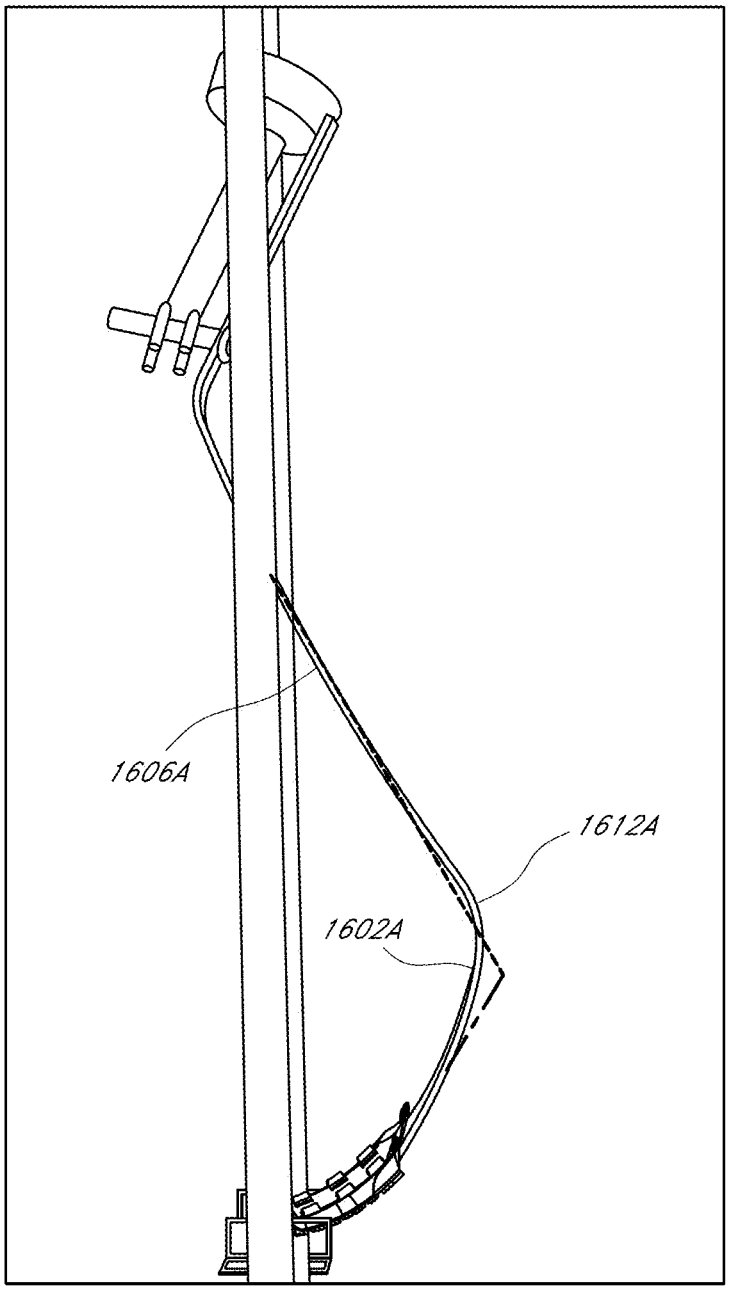
FIGS. 16A-16D illustrate a crutch configured to provide energy storage and return to a user during ambulation, according to some embodiments.
Figure 16B:
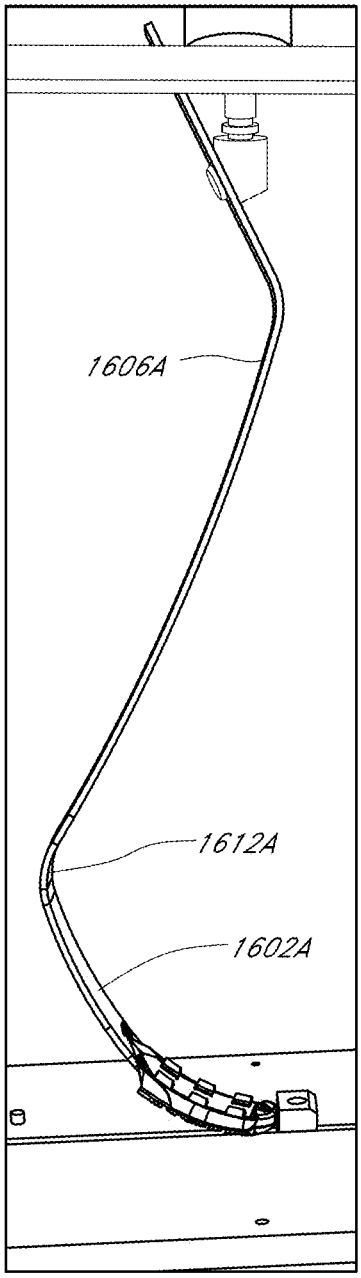
Figure 16C:
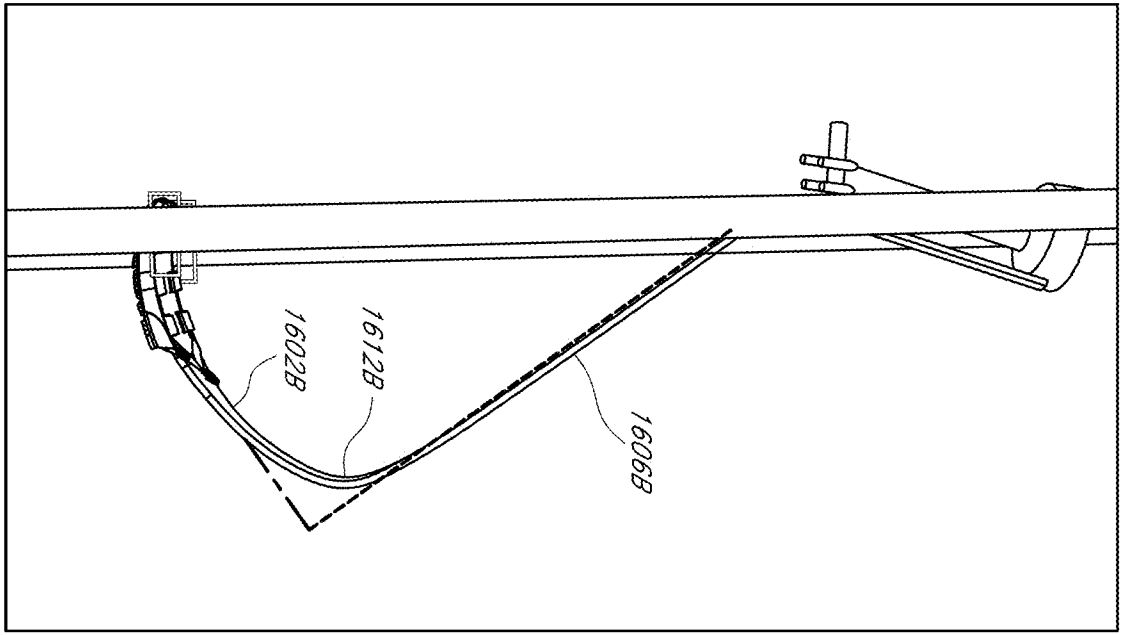
Figure 16D:
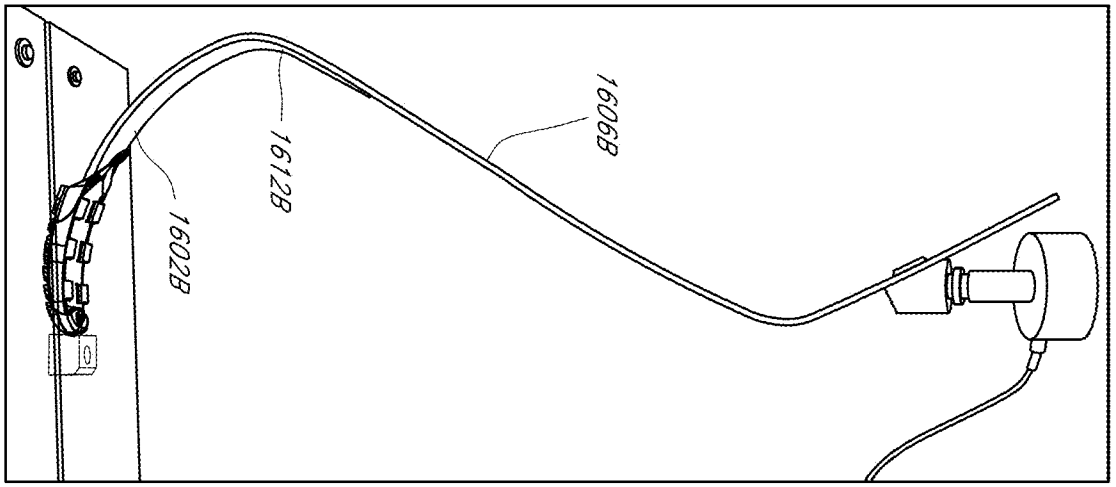

FIG. 15 illustrates a crutch 1500 that can provide energy storage and return to a user during ambulation, according to some embodiments. The crutch 1500 has a varying width along its length. In this example, the central portion 1506 is narrower (i.e., it has a smaller width transverse to the longitudinal axis of the crutch when viewed from the front) than the curved distal portion 1508 and the proximal portion 1504. The narrowed central portion 1506 can include a contoured medial edge that contours laterally to advantageously allow more space for the user while the crutch 1500 is in use and additionally makes the crutch 1500 easier to rotate. The narrowed central portion 1506 can advantageously reduce drag on the crutch 1500 (e.g., by reducing the amount of surface area of the prosthetic crutch that faces airflow during use), as well as reduce the weight of the crutch 1500. The narrowed central portion 1506 can also advantageously enhance flexion (e.g., reduced resistance to flexion) of the crutch 1500 in use.

In other examples, the central portion 1506 can have the same width as the proximal portion 1504 and/or the curved distal portion 1508. In some examples, the central portion 1504 can be narrower than the curved distal portion 1508 so that the width of the crutch flares outward (e.g., gradual flare) from the central portion 1506 to the curved distal portion 1508. In some embodiments, the width of the crutch (e.g., the crutch 100-500, 1100-1400) can be uniform throughout the length of the crutch, such as from the distal end to the proximal end.

FIGS. 16A-16D respectively illustrate non-limiting examples of a crutch in an un-flexed and flexed state. As the crutch is compressed, the crutch flexes and transitions from the crutch illustrated in FIGS. 16A-16B to the crutch illustrated in FIGS. 16C-16D. As shown, the end of the central portion 1606A proximal the second transition section 1612A and the end of the curved distal portion 1602A proximal the second transition section 1612A become rounded when the crutch is flexed and the central portion 1606A pivots forward (see 1606B in FIGS. 16C-16D) and the curved distal portion 1602A pivots rearward (e.g., flattens) so that more of the distal portion 1602 contacts the support surface (see 1602B in FIG. 16D). Such flexing stores energy in the crutch that is released in a later portion of a stride to propel the user forward during ambulation. In addition, the angle between the central portion 1606 and the curved distal portion 1608 decreases. As a result, the height of the crutch is reduced and the flexed crutch stored energy, which it releases as it un-flexes back to the un-flexed state. Further, as can be seen in FIGS. 16A-16D, as the crutch is flexed, the sole or contact surface of the crutch rolls or pivots rearward, so that the center of pressure on the sole moves rearward as the crutch is flexed.

Non-Limiting Example

Ambulation with conventional crutches can take up to twice the energy of normal gait and can strain the hands, wrists, and arms. In contrast, the crutch with energy storage and return in the embodiments described herein requires less energy, results in a longer stride, and/or results in less the strain on the hands, wrists, and arms during use.

A comparative analysis was performed between a first set of conventional crutches that do not provide energy storage and return, and a second set of crutches that do provide energy storage and return to a user, such a crutch as described herein.

Using each set of crutches in turn (individually referred to as "crutch with energy storage" and "crutch without energy storage"), a user placed two crutches in front of him, propelled himself between the crutches, and swung his feet though, keeping both feet generally parallel. Various measurements were recorded, including but not limited to, step length (e.g., stride length), total length of rollover, ground reaction force and center of pressure, FIGS. 17-20 correspond to the crutch without energy storage (e.g., a conventional crutch) and FIGS. 21-24 correspond to the crutch with energy storage. Each will be discussed in turn.

Crutch without Energy Storage

Figure 17A:
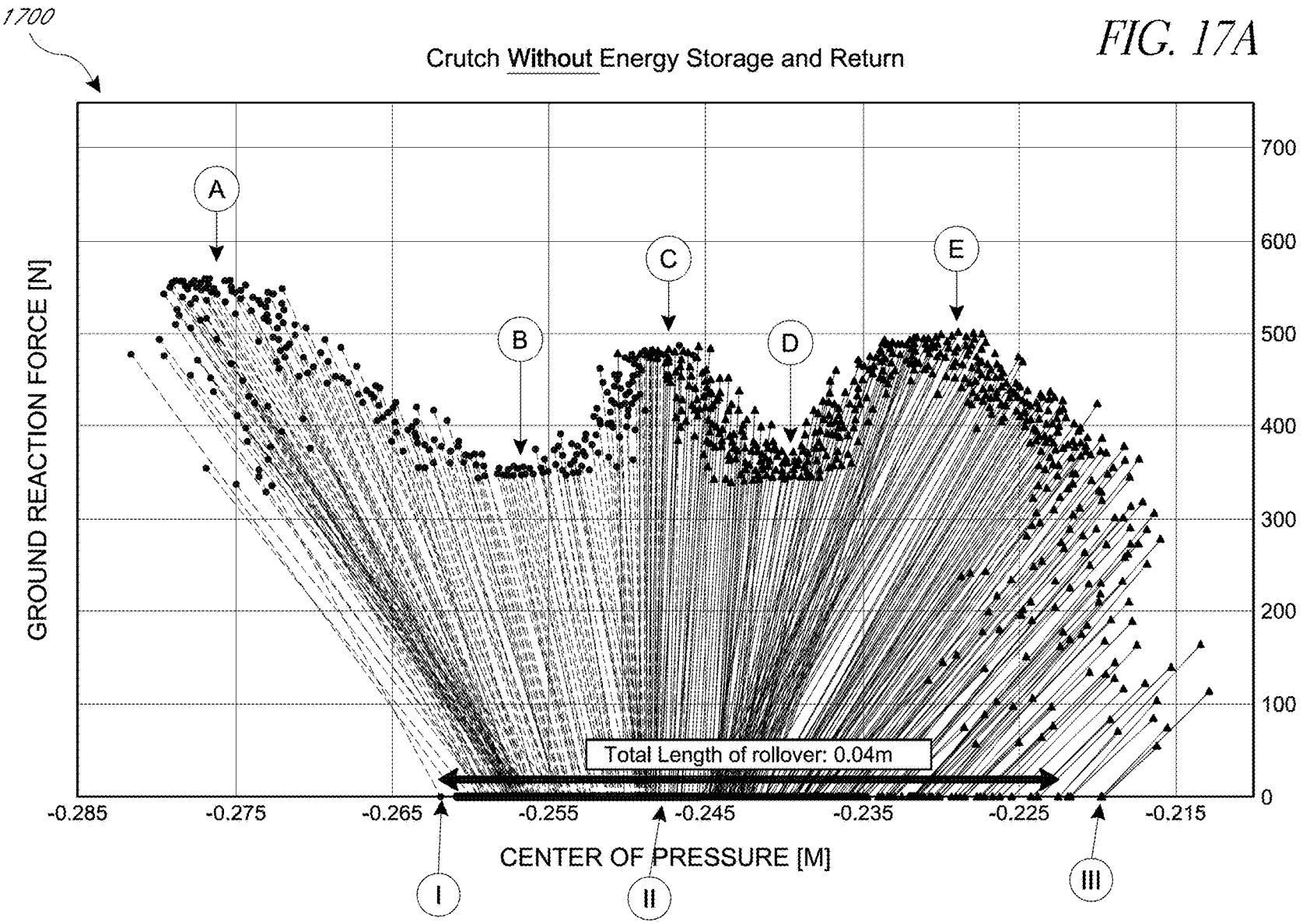
FIG. 17A illustrates a Pedotti diagram representing reaction forces acting on an conventional crutch without energy storage, where a user propelled himself using two crutches at the same time and swinging through with both feet.

FIG. 17A illustrates a vector diagram representing ground reaction forces acting on a crutch without energy storage (sometimes referred to as a traditional crutch) where a user propels himself using two traditional crutches at the same time and swings through with both feet parallel. This vector diagram 1700, also known as a Pedotti or Butterfly diagram, is made of up successive representations, at 1 ms intervals (or 1000 samples per second) of the magnitude, direction, and point of application of the ground reaction force vector.

The vertical axis describes the magnitude, in Newtons, of the ground reaction force exerted on a crutch (in this example, the left crutch). The ground reaction force can generally be described as the force exerted by the ground as a reaction to the force the crutch exerts on the ground. In other words, the ground reaction force is equal to the mass of the crutch (including the portion of the user's mass supported by the crutch) multiplied by the acceleration (e.g., the sum of gravitation acceleration and the acceleration or deceleration caused by the movement of the user.) An average person has a mass of 80 kg. Thus, when the person is standing still, the total ground reaction force is approximately 784 N. Accordingly, assuming equal weight distribution across both the crutches, full weight bearing on the crutches without movement by the user will result in a ground reaction force of approximately 392 N.

The horizontal axis describes the center of pressure, in meters, of the crutch during ambulation. As the user moves through the crutch stride, the base of the crutch contacts the walking surface, which can include multiple stages of ground interactions including ground strike, rollover, and push-off. The horizontal axis describes the position of the ground reaction force relative to the ground contact portion of the base of the crutch. Thus, from the span of the center of pressure readings along the horizontal axis, one can discern the total length of rollover (e.g., the length of the walking surface contacted by the crutch).

The Pedotti diagram 1700 illustrates two distinct sets of data, the first denoted with broken lines and circular markers and the second denoted with solid lines and triangular makers. The first set of data (on the left) corresponds to the first stages of crutch ambulation. As illustrated, the vectors of the first set of data (e.g., the broken lines) are inclined contrary to the direction of movement. That is, the vectors have a negative slope. This represents a braking force which causes a breaking action on the body, thereby slowing it down. Because the user desires to move forward, this braking force is not desirable as it limits the forward progression of the user.

The second set of data (on the right) corresponds to later stages of crutch ambulation. As illustrated, the second set of data (e.g., the solid lines) has a vector inclination in the direction of the user's movement. That is, the vectors have a positive slope. This represents a propelling or forward force which can cause a user to move forward. As such, it can be desirable for the ground reaction force vectors to have a more positive slope.

The envelope of the vectors in diagram 1700 presents a pattern characterized by three maxima (Points A, C, and E) and two minima (Points B and D). These points, A, B, C, D, and E, as well as Points I, II, and III, correspond to stages of crutch ambulation. The positions of the user and crutch at each of these stages is illustrated in FIGS. 18A, 18B, 18C, 18D, and 18E and FIGS. 19A, 19B, and 19C, respectively.

Figure 19A:
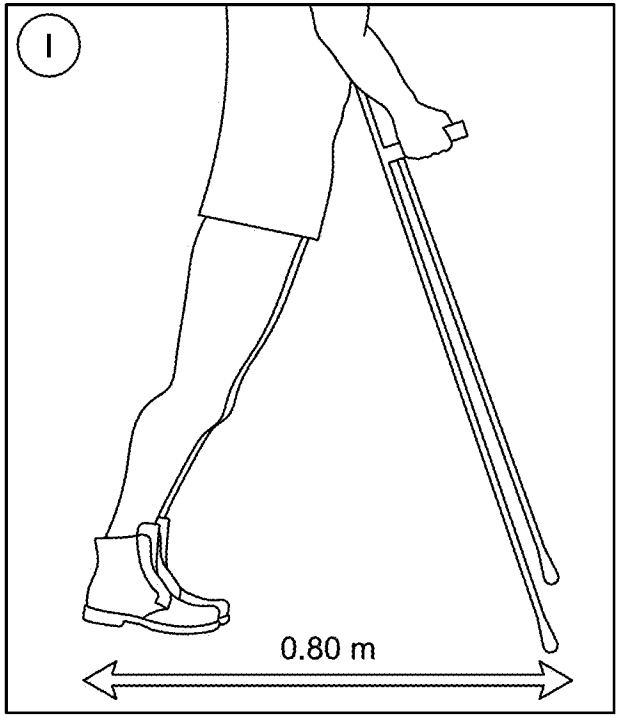
FIGS. 19A-19C illustrates the position of the user and the conventional crutch without energy storage at points I, II, and III of FIG. 17A.

Point I corresponds to the initial contact (sometimes referred to as heel-strike) of the crutch with the walking surface and indicates the beginning of the loading response. As illustrated in FIG. 19A, the user reaches the crutches approximately 0.8 meters in front of his body (measured from the heel of the user) before contacting with the walking surface. The initial contact corresponds to ground reaction force having a relatively substantial braking force. In addition, the center of pressure resides approximately at a lateral border of the base of the crutch 1 contact.

Figure 18A:
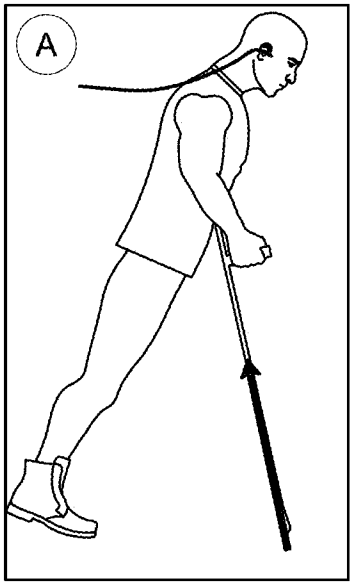
FIGS. 18A-18E illustrate the position of the user and the conventional crutch without energy storage at points A, B, C, D, and E of FIG. 17A.
Figure 18B:
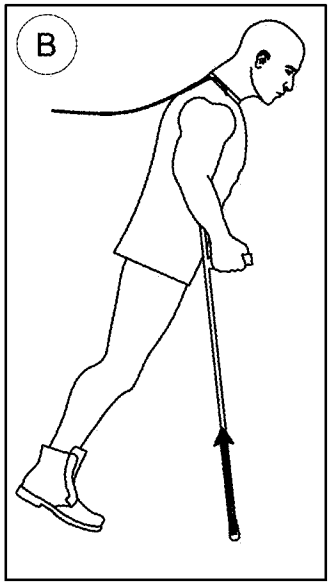

The first maxima of the envelope occurs at Point A, which corresponds to the point at which the user begins to lean forward onto the crutch (illustrated in FIG. 18A). At this point, the ground reaction force is at its highest value because the user's weight is bearing down on the crutch and the body's downward velocity is being arrested. As described above, the user's weight at rest would result in a ground reaction force of approximately 392 N. At Point A, diagram shows showing a rapid rise to a ground reaction force value in excess of body weight (approximately 550 N).

The first minima occurs at Point B, which corresponds to the time at which the most of the user's body weight is bearing down on the crutch (illustrated in FIG. 18A). Here, the ground reaction force is at a minima because the user's forward momentum removes some of the force bearing down on the crutch. As the user leans forward onto the crutches, the ground is partially unloaded and the ground reaction force drops below body weight.

Figure 18C:
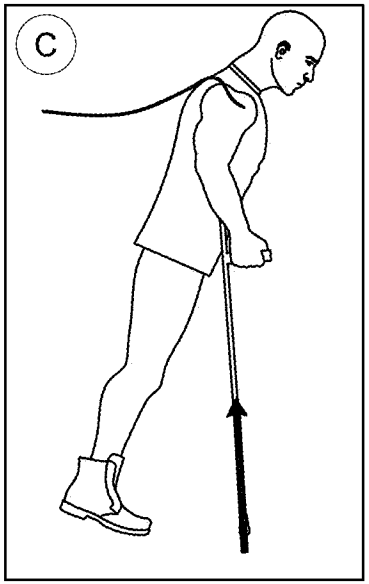
Figure 19B:
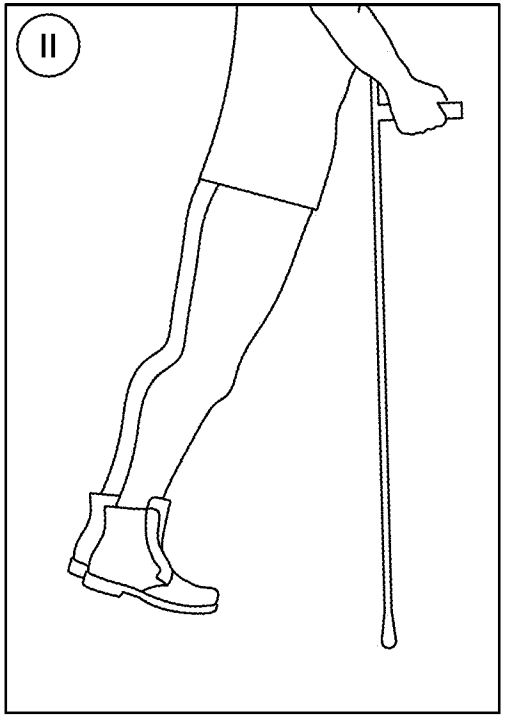
Figure 19C:
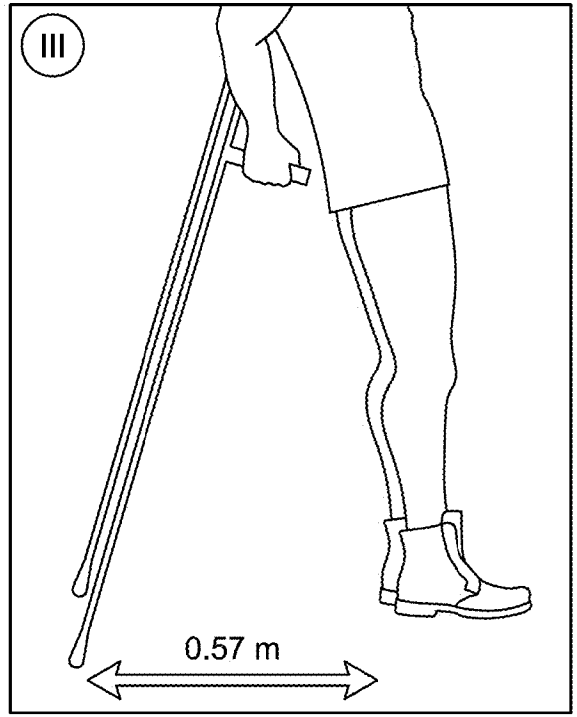

The second maxima occurs at Point C and corresponds to the point at which the user pushes himself up with his shoulders (illustrated in FIGS. 18C and 19B). Here, the user is braking himself while working towards increased height of the body. The ground reaction force rises as a result of the weight of the user in conjunction with downward force applied by the user to lift his body higher in the air.

Figure 18D:
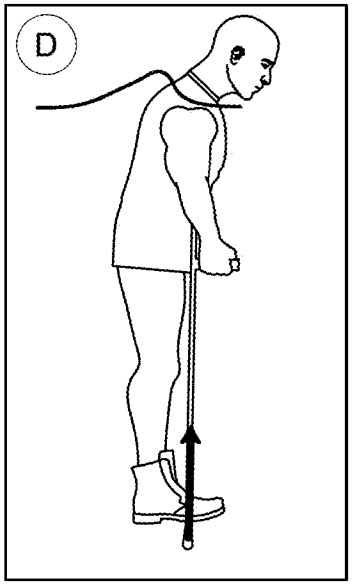

The second minima occurs at Point D (and Point II) and corresponds to the point at which the user reaches his maximum height (illustrated in FIG. 18D). Here, the ground is again partially unloaded and the ground reaction force drops below body weight.

Figure 18E:
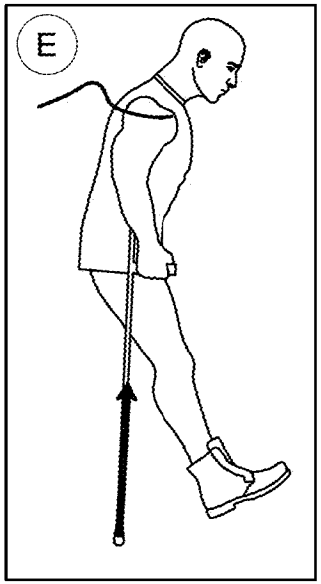

The third and final maxima occurs at Point E and corresponds to the point at which the user propels himself forward before landing on his feet (illustrated in FIG. 18E). Here, the user's weight in addition to the force used by the user to propel himself forward causes another peak value of the ground reaction force.

Finally, Point III corresponds to the point at which the user will lift the crutch off the walking surface to take another step. Sometimes this is referred to as "toe-off." As illustrated in 19C, the user's feet land approximately 0.57 meters in front of the crutches. Accordingly, the total stride or step length of the user using the crutch without energy storage is approximately 1.37 meters.

The Pedotti diagram 1700 indicates that the center of pressure moves from the lateral border of the crutch at initial contact (ground-strike), along the base or sole of the crutch, to the opposing lateral border (toe-off). In addition, some of the vectors near toe-off are relatively weak and may be attributed to bumping, dragging, or shifting of the crutch. Thus, the total length of rollover (e.g., the distance between ground-strike (left) and toe-off (right), or contact surface of the end of the crutch) is approximately 0.04 meters (from approximately −0.26 to −0.22 in FIG. 17A, with readings outside this range possibly due to bumping and/or dragging of the contact end of the crutch).

Figure 17B:
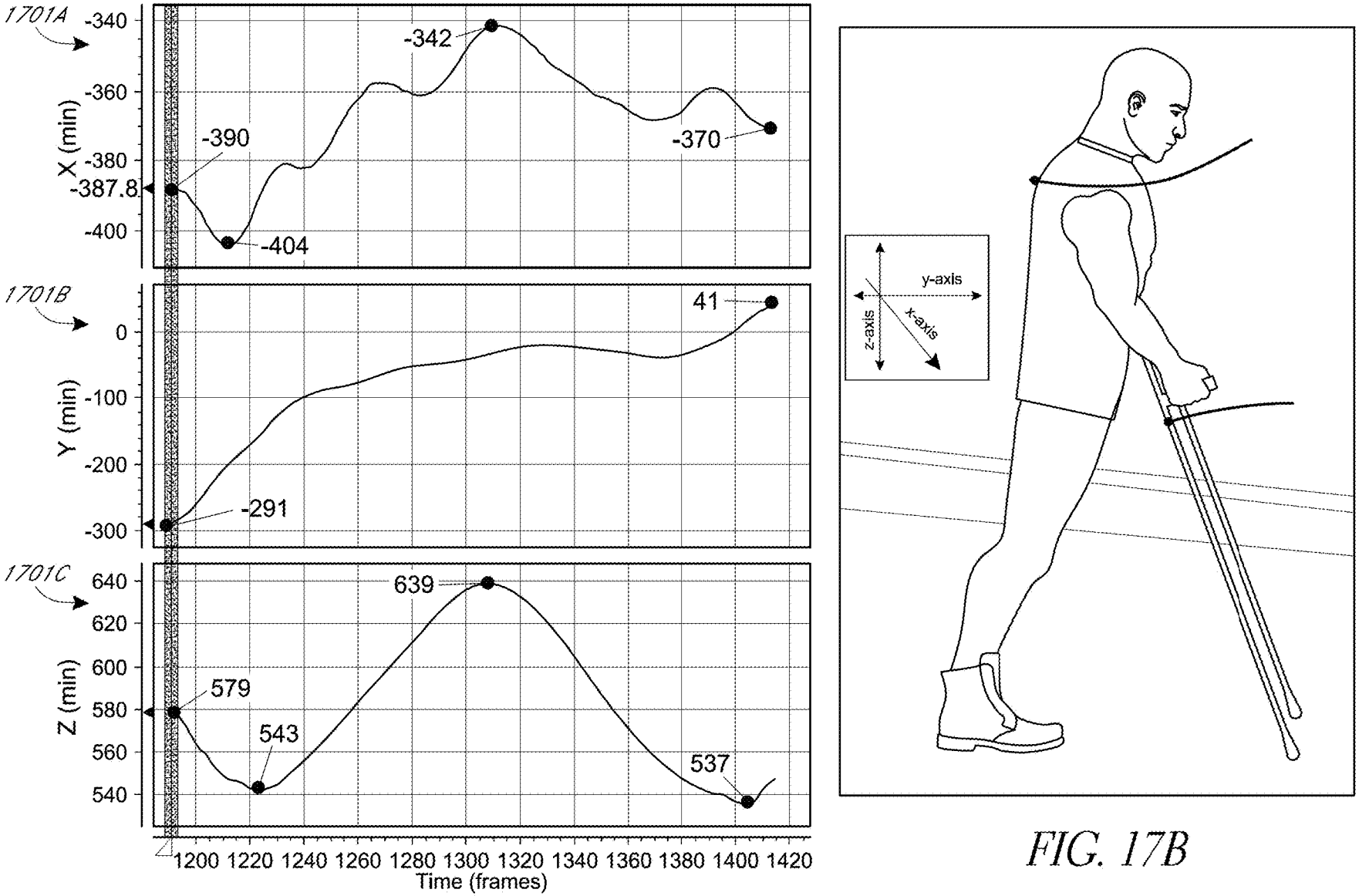
FIG. 17B illustrates an X, Y, and Z graph corresponding to a user propelling himself using two conventional crutches at the same time and swinging through with both feet.

FIG. 17B illustrates an X-axis, Y-axis, and Z-axis graph corresponding to a distance, along the particular axis, from the center of the user's back to the crutch at the location of the user's hand, as the user propels himself using two conventional crutches. For these examples, the measurements along the x-axis correspond with how wide the user's hands are relative to the user's body during crutch ambulation, the measurements along the y-axis correspond to how far in front of or behind the body the user's hands are during crutch ambulation, and the measurements along the z-axis correspond to the height of the user's back relative to the user's hands are during crutch ambulation.

The X-axis graph 1701A indicates that at the start of ambulation, each of the user's hands are approximately 390 mm laterally apart from the user. As the user proceeds, the hands transition from being further apart (approximately 404 mm from the body), to closer together (approximately 342 mm from the body) to a little further apart (approximately 370 mm from the body) at the end of a stride.

The Y-axis graph 1701B indicates that at the start of ambulation, the user's hands are approximately 291 mm in front of the user (e.g., approximately at the center of mass of the user). As the user proceeds, the hands move behind the body (approximately 41 mm behind) at the end of a stride.

The Z-axis graph 1701C indicates that at the start of ambulation, the user's hands are approximately 579 mm below the back (e.g., at the shoulders) of the user. As the user proceeds, the hands raise slightly such that they are approximately 543 mm below the back. Then, as the user pushes his shoulders up and extends his arms, the distance is height is increased to approximately 639 mm. The height difference then transitions back to approximately 537 mm at the end of the stride.

Figure 20:
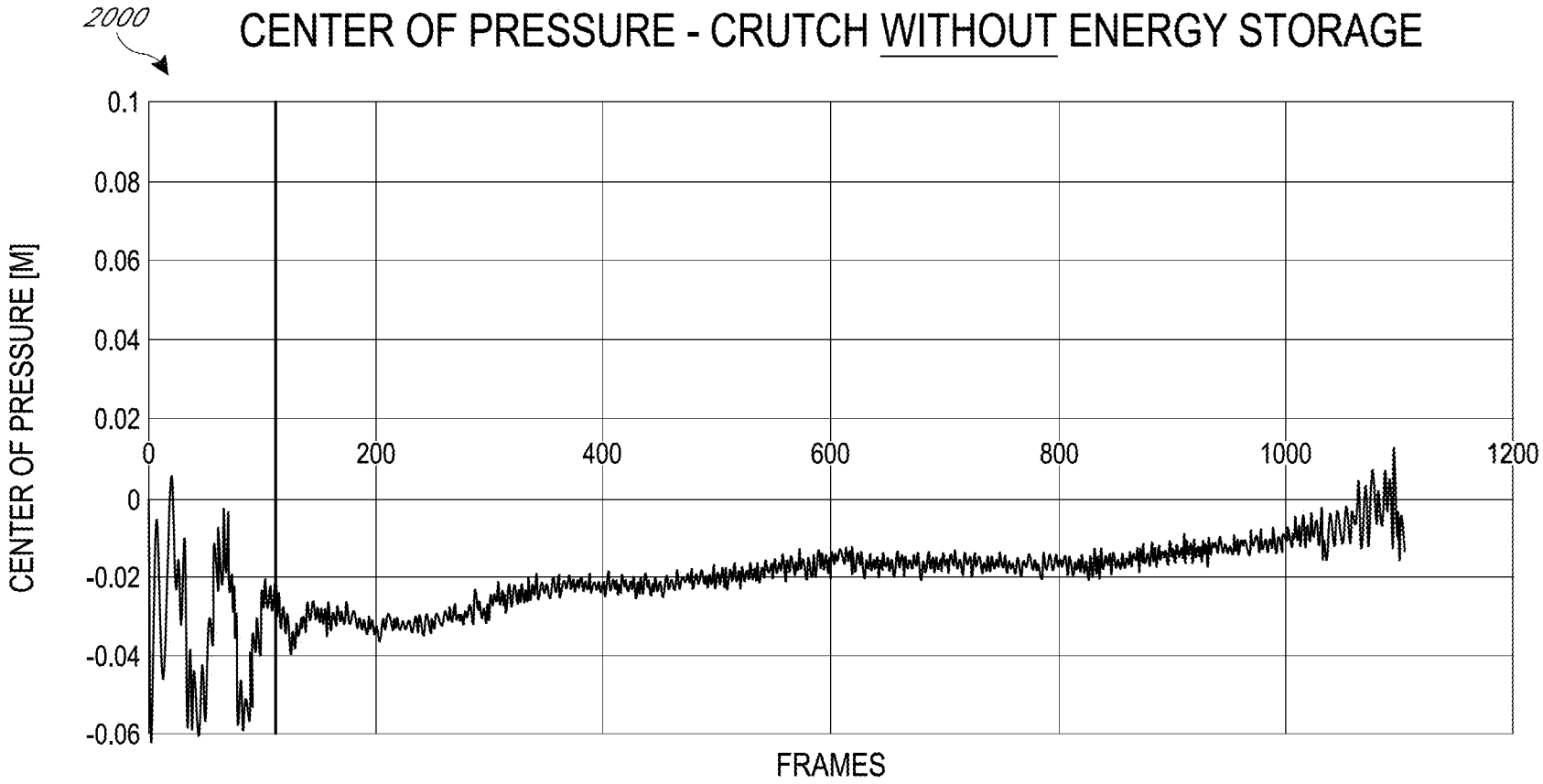
FIG. 20 illustrates a diagram corresponding to the center of pressure of a conventional crutch without energy storage during ambulation.

FIG. 20 illustrates a diagram 2000 corresponding to the center of pressure of the crutch without energy storage. The center of pressure can provide an indication of the stability of the crutch in the user's hands. For example, an oscillating center of pressure can indicate a lack of stability while a fluid increase or decrease in center of pressure can indicate higher stability. The wavering nature of the center of pressure in diagram 2000 indicates that the user felt unstable (e.g., his hands we shaky) while using the crutch without energy storage.

Crutch with Energy Storage

Figure 21A:
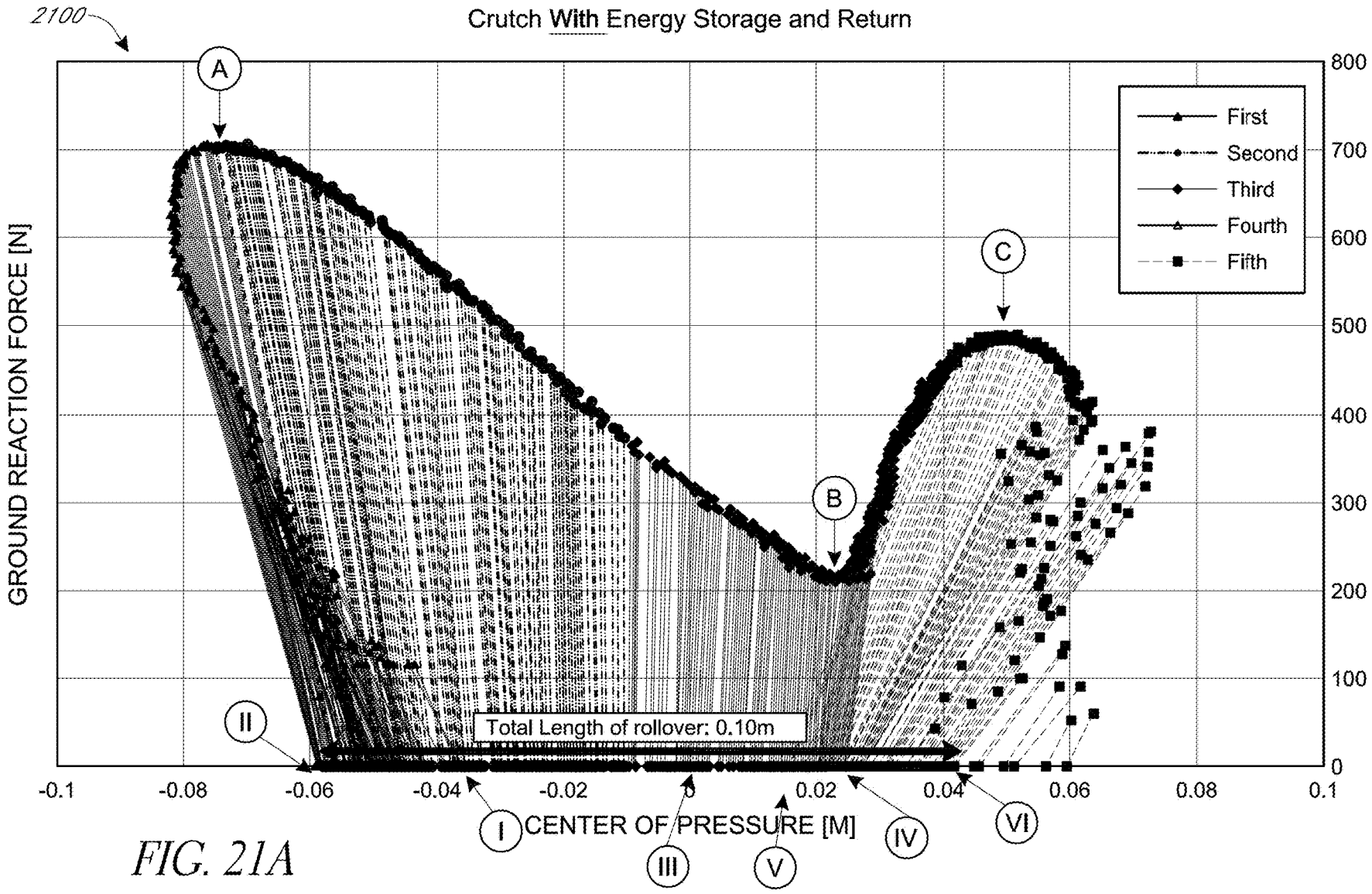
FIG. 21A illustrates a Pedotti diagram representing reaction forces acting on a crutch with energy storage, where a user propelled himself using two crutches at the same time and swinging through with both feet.

FIG. 21A illustrates a Pedotti diagram representing reaction forces acting on a crutch with energy storage, where a user propelled himself using two crutches at the same time and swinging through with both feet generally parallel. The Pedotti diagram 2100 illustrates five series of data. Generally spanning from left to right, the first series is denoted with solid black lines and black triangular markers, the second series is denoted with broken gray lines and black circular markers, the third series is denoted with broken gray lines and black diamond-shaped markers, the fourth series is denoted with solid black lines and triangular markers, and the fifth series is denoted with broken dark gray lines with black square markers.

The envelope of the vectors in diagram 2100 presents a pattern characterized by two maxima (Points A and C) and a minima (Point B). These points, A, B, C, as well as Points I, II, III, IV, V, and VI, correspond to stages of crutch ambulation. The positions of the user and crutch at each of these stages is illustrated in FIGS. 22A, 22B, 22C, 23A, 23B, 23C, 23D, 23E and 23F, respectively.

Figure 23A:
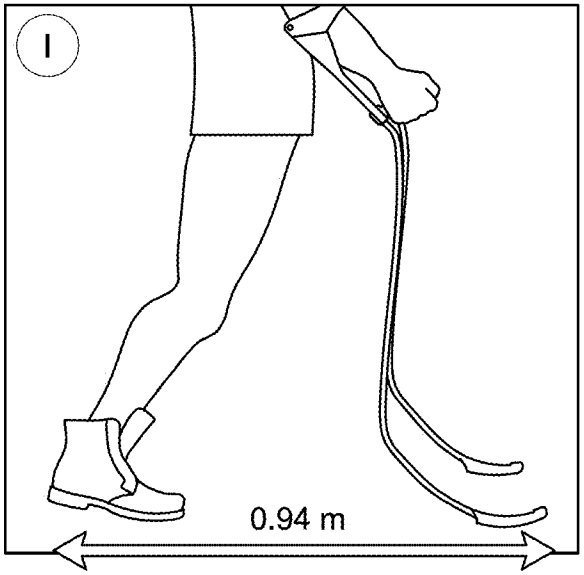
FIGS. 23A-23F illustrates the position of the user and the crutch with energy storage at points I, II, III, IV, and V of FIG. 21A.
Figure 23B:
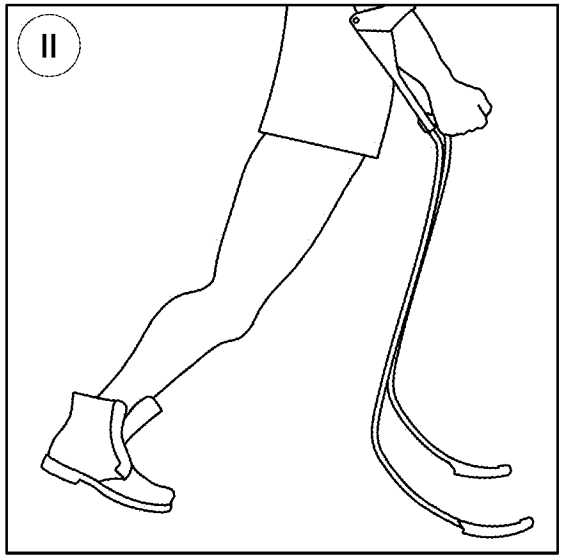
Figure 23C:
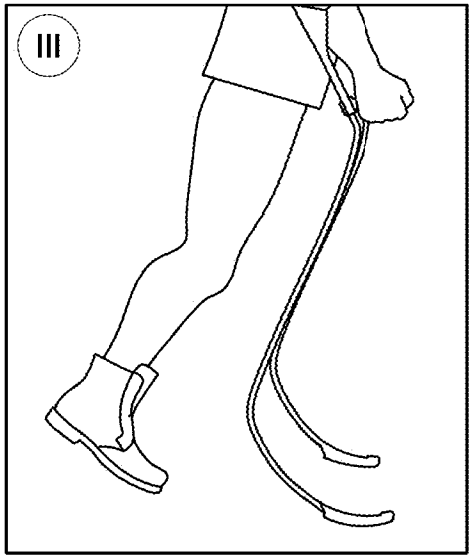
Figure 23D:
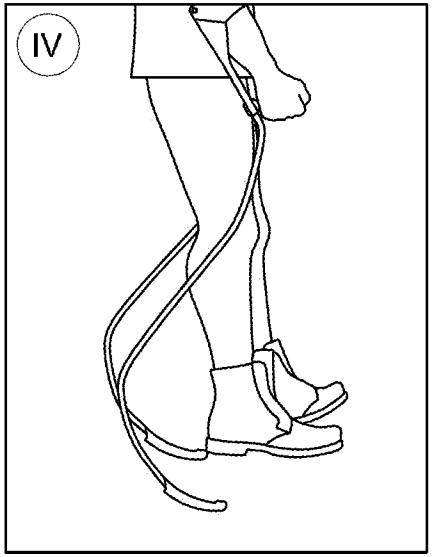
Figure 23E:
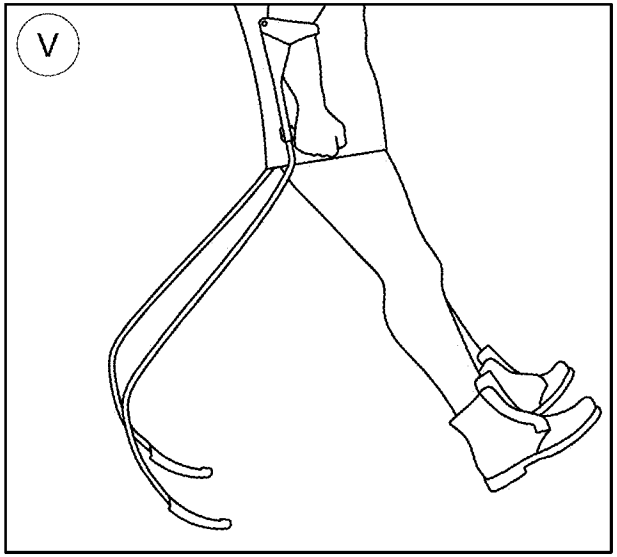

Point I corresponds to the initial contact of the crutch with the walking surface and indicates the beginning of the loading response. As illustrated in FIG. 23A, the user reaches the crutches approximately 0.94 meters in front of his body (measured from the heel of the user) before contacting with the walking surface. In contrast to the crutch without energy storage, due to flexing of crutch, as the curved distal end of crutch with energy storage contacts the walking surface, the curved distal end (e.g., the foot of the crutch) gets slightly flatter. This not only increases energy storage and the surface at which the crutch contacts the ground, but also moves the center of pressure backward to −0.06 (Point II). The initial contact (Point II) corresponds to a center of pressure of approximately −0.038 meters and then the center or pressure proceeds to go more negative, until it eventually transitions towards the positive direction around Point II. It should be noted that although the vectors of the first series of data are inclined contrary to the direction of movement, indicating a backwards breaking force, this is where the energy storing starts.

The first maxima occurs at Point A and corresponds to the point at which the user pushes himself up with his shoulders (illustrated in 22A). Here, unlike the crutch without energy storage, the vectors of the ground reaction forces move towards a more neutral position when the user is being pushed upwards. Thus, the user is braking himself far less than when using the crutch without energy storage.

Figure 22C:
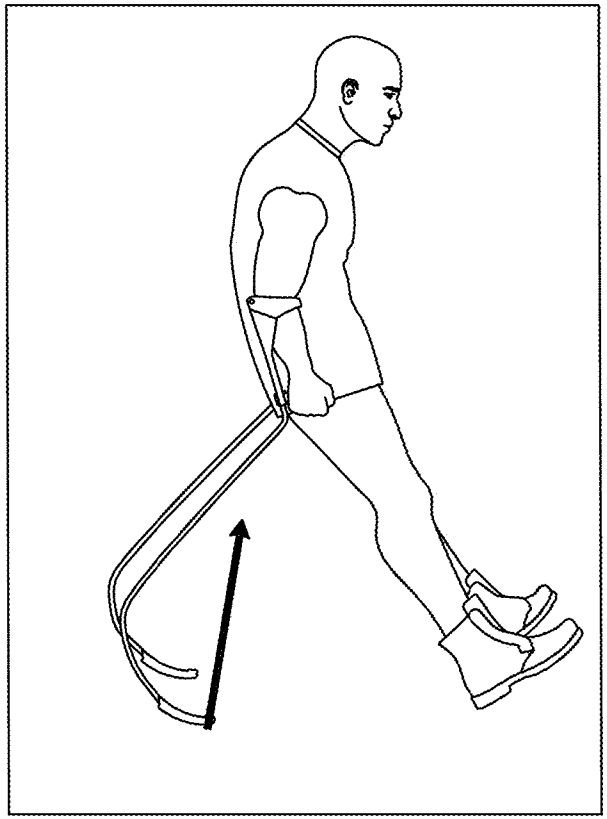
FIGS. 22A-22C illustrate the position of the user and the crutch with energy storage at points A, B, and C of FIG. 21A.
Figure 22B:
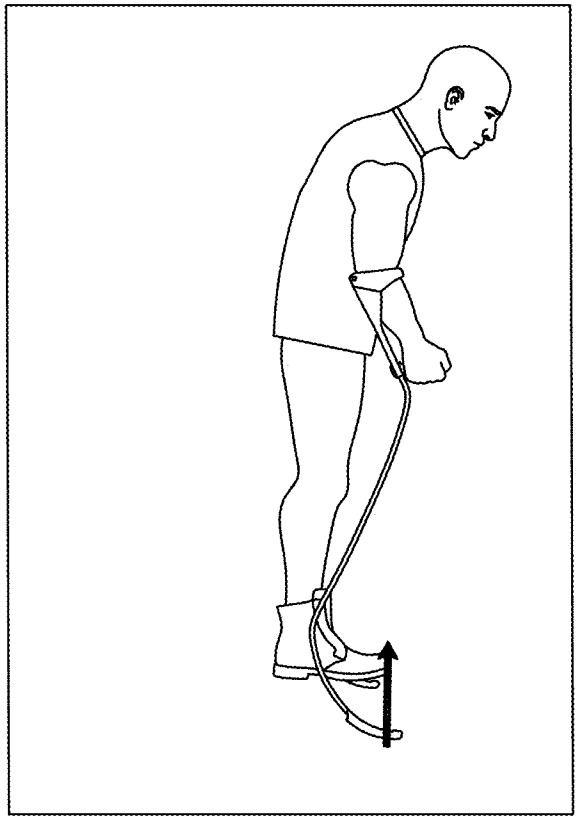
Figure 22A:
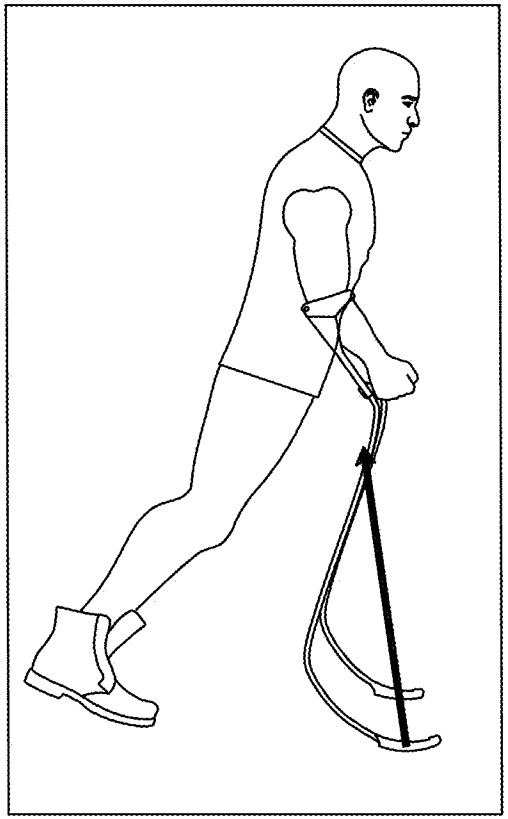

The minima occurs at Point B and corresponds to the point at which the user reaches his maximum height (illustrated in FIG. 22B). Here, the ground is partially unloaded and the ground reaction force drops below body weight.

At point IV, the center of pressure goes backwards, driving the user forward and causing the ground reaction force vectors to change to forward propulsion. The center of pressure continues to go backward until Point V, where the center of pressure transition to forward progression and the user continues forward propulsion.

The second maxima occurs at Point C and corresponds to the point at which the user propels himself forward before landing on his feet (illustrated in FIG. 18E). Here, the user's weight in addition to the force used by the user to propel himself forward causes another peak value of the ground reaction force. The combination of shape of the foot or sole area of the crutch and the forces propel the user even more forward during this stage.

Figure 23F:
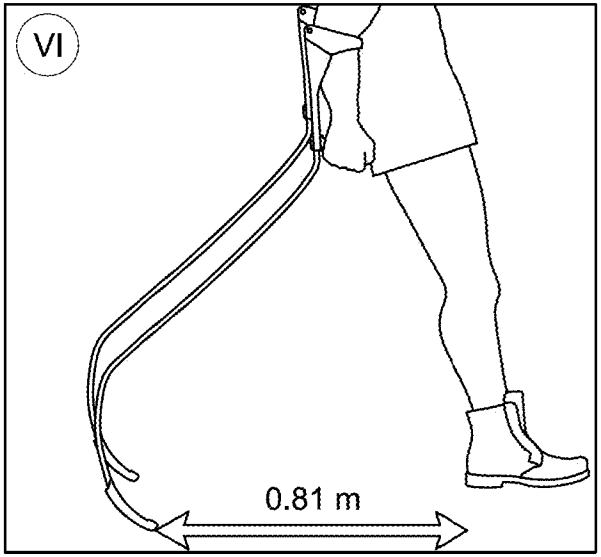

Point VI corresponds to the point at which the user will lift the crutch off the walking surface to take another step. As illustrated in FIG. 23F, the user's feet land approximately 0.81 meters in front of the crutches. Accordingly, the total stride or step length of the user using the crutch without energy storage is approximately 1.75 meters, which is 0.41 meters more than the stride length of the crutch without energy storage.

The Pedotti diagram 2100 indicates that the center of pressure moves from a point of ground contact (Point I) to a more lateral border of the crutch (Point II), rolls over the base or sole of the crutch (Point III), rolls back slightly (Point IV), and then continues to roll over the base or sole of the crutch (Point V) to the opposing lateral border for toe-off (Point VI). As described above, some of the vectors near toe-off are relatively weak (e.g., attributed to bumping, dragging, or shifting of the crutch) and are not considered when determining total length of rollover. Thus, the total length of rollover (e.g., the distance between heel-strike (left) and toe-off (right)) is approximately 0.10 meters (from approximately −0.06 to −0.04 in FIG. 17B, with readings outside this range possibly due to bumping and/or dragging of the contact end of the crutch). This is approximately 0.07 meters longer than the crutch without energy storage. While this can be attributed to the length or shape of the foot, as described herein, the shape and length of the contact surface contributes to step length.

In addition, the ground reaction force vectors of diagram 2100 are generally parallel with each other, and generally do not cross. In contrast, the vectors of diagram 1700 for the standard crutch are not very evenly distributed and do cross each other, indicating energy loss because of the breaking force, as well as instability. Accordingly, the vectors of each diagram 1700, 2100 indicate that the crutch with energy storage provides for a generally smoother ambulation experience than the conventional crutch.

FIG. 21B illustrates an X-axis, Y-axis, and Z-axis graph corresponding to a distance, along the corresponds axis, from the top center of the user's back to the crutch at the location of the user's hand, as the user propels himself using two crutches that provide energy storage and return. For these examples, measurements along the x-axis correspond how wide the user's hands are relative to the body during crutch ambulation, measurements along the y-axis correspond to how far in front of or behind the body the user's hands are during crutch ambulation, and measurements along the z-axis correspond to the height of the user's back relative to the user's hands during crutch ambulation.

The X-axis graph 2101A indicates that at the start of ambulation, each of the user's hands are approximately 364 mm laterally apart from the user, which is approximately 26 mm closer than the convention crutch, as described with respect to FIG. 17B. As the user proceeds, the hands initially move closer to the body (to approximately 308 mm), before moving further from the body (to approximately 372 mm). Overall, as compared to the conventional crutch, the user's hands generally stay slightly closer to the body when using the crutch with energy storage. This can aid in stability as well as allow the user to reach an increased height (see Z-axis graph), which can increase stride length. In addition, while the z-axis graph curves are similar, the curve corresponding to the crutch with energy storage. This can be attributed to increased stability of the user while using the crutch with energy storage.

The Y-axis graph 2101B indicates that at the start of ambulation, the user's hands are approximately 236 mm in front of the user's back (e.g., approximately from the center of mass of the user). As the user proceeds, the hands transition to behind the body (approximately 34 mm behind). As compared to the conventional crutch, two y-axis graphs are fairly similar.

The Z-axis graph 2101C indicates that at the start of ambulation, the user's hands are approximately 406 mm below the back (e.g., at the shoulders) of the user. As the user pushes his shoulders up and extends his arms, the distance is height is increased to approximately 524 mm. The height difference then transitions back to approximately 365 mm. Accordingly, the change in height difference between the hands and the back is approximately 159 mm (e.g., peak difference minus minimum difference). In contrast, the change in height difference for the conventional crutch is approximately 102 mm. This indicates that the user is able to extend arms further while supported on the crutch with energy storage. This can reduce hunching, thereby reducing fatigue during use. In addition, it may provide for increased stride length.

Figure 24:
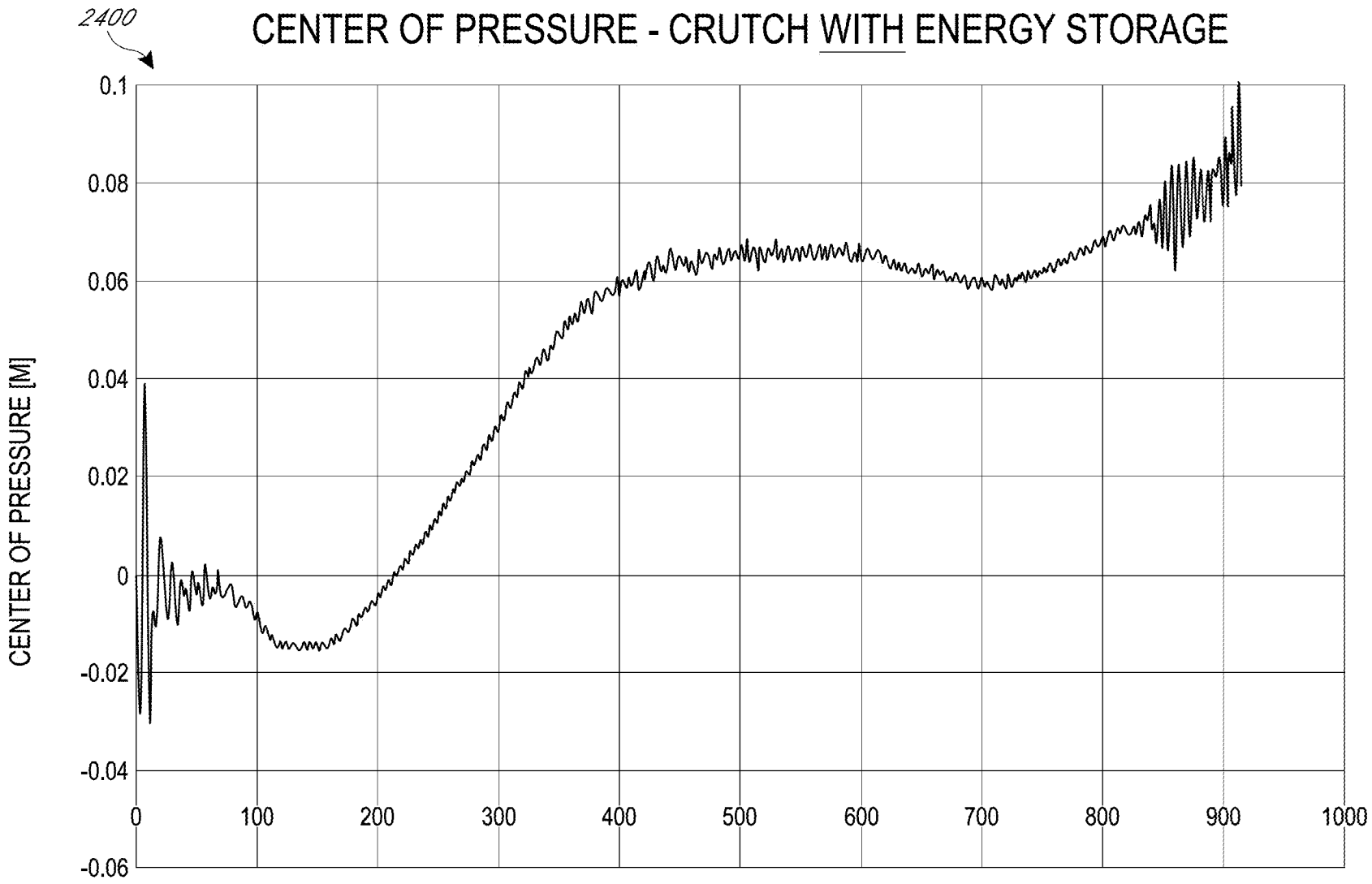
FIG. 24 illustrates a diagram corresponding to the center of pressure of a crutch with energy storage.

FIG. 24 illustrates a graph 2000 corresponding to the center of pressure of the crutch without energy storage. Although the center of pressure oscillates near the beginning of the graph, the graph 2000 generally shows a fluid curve to the center of pressure, indicating the crutch felt stable to the user.

Crutch with Energy Storage Versus Crutch without Energy Storage

As seen from Table 1 below which corresponds to FIGS. 17-24, the crutch with energy storage was shown to have a longer step length (1.75 m), as compared to the crutch without energy storage (1.37 m). In addition, the crutch with energy storage was shown to have a longer length of surface contact (0.10 m), as compared to the crutch without energy storage (0.04 m), which attributes to the increased stability and step or stride length of the crutch with energy storage.

TABLE 1

Step length and length surface contact.

| | Crutch without Energy Storage | Crutch with Energy Storage |
|---|---|---|
| Step length [m] | 1.37 | 1.75 |
| Length of surface contact [m] | 0.04 | 0.10 |

Table 2 summarizes the ground reaction forces experienced with the crutch with energy storage (e.g., the crutch 100-500, 1100-1500) and those experienced with the conventional crutch. As shown, the crutch with energy storage initially has a higher ground reaction force than the conventional crutch. This can be attributed to the flexion of the crutch upon contact with the ground, which will eventually un-flex and will return the energy to the user. Because of the energy return, the ground reaction forces are generally lower than the conventional crutch after this initial contact.

TABLE 2

Maxima and minima of ground reaction force envelope.

| | Crutch without Energy Storage | Crutch with Energy Storage |
|---|---|---|
| 1st maxima [N] | 550 | 705 |
| 1st minima [N] | 330 | 210 |
| 2nd maxima [N] | 480 | 490 |
| 2nd minima [N] | 360 | NA |
| 3rd maxima [N] | 500 | NA |

Figure 25:
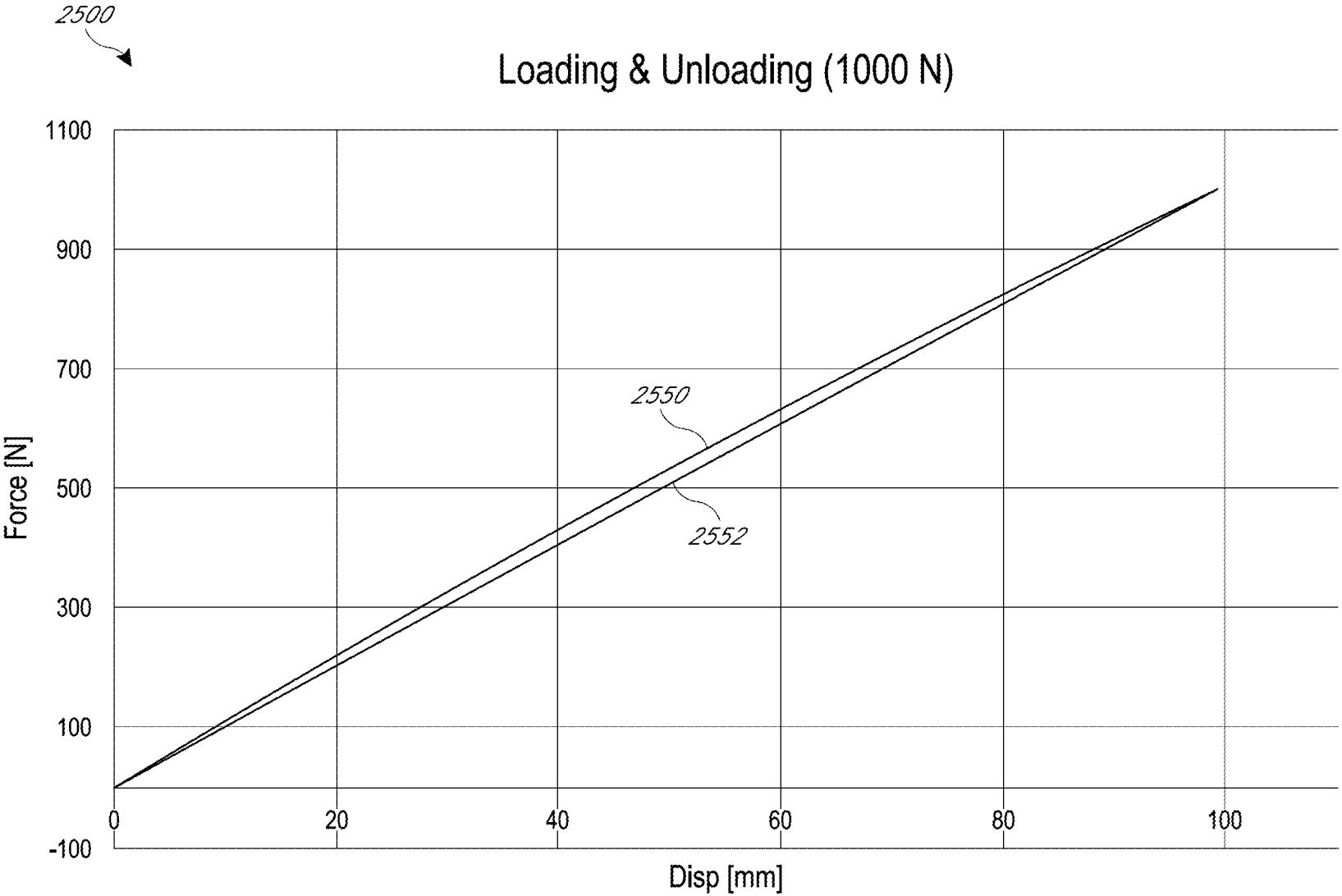
FIG. 25 illustrates a diagram corresponding to energy return and efficiency of a crutch configured to provide energy storage and return to a user during ambulation, according to some embodiments.

FIG. 25 illustrates the loading and unloading Force-Displacement curve 2500 of a crutch configured to provide energy storage and return to a user during ambulation, according to some embodiments (e.g., like the crutch 100-500, 1100-1500). As described herein, an un-loaded crutch can correspond to FIGS. 16A-16B and a loaded crutch can correspond to FIGS. 16C-16D. As illustrated in graph 2500, the crutch with energy storage has relatively linear Force-Displacement curves and is able to support loading in excess of 1000 N. In addition, the amount of energy provided to the crutch (as illustrated by curve 2550) is substantially equivalent to the amount of energy returned by the crutch (as illustrated by curve 2552) Thus, the crutch with energy storage is efficient in that there is relatively little energy loss associated with loading and unloading the crutch.

An example of the efficiency of the crutch with energy storage is shown in Table 3. In this example, 51.2 joules were provided on the crutch to load the crutch, and 50.1 joules were returned by the crutch. Accordingly, the crutch was 97.9% efficient with respect to energy output relative to energy input.

TABLE 3

Loaded versus unloaded crutch with energy storage.

| | |
|---|---|
| Loading (Joules) | 51.2 |
| Unloading (Joules) | 50.1 |
| Efficiency | 97.9% |

Terminology

Although this disclosure has been described in the context of certain embodiments and examples, it will be understood by those skilled in the art that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art. It is also contemplated that various combinations or sub-combinations of the specific features and aspects of the embodiments may be made and still fall within the scope of the disclosure. For example, features described above in connection with one embodiment can be used with a different embodiment described herein and the combination still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may include, additional to its essential features described herein, one or more features as described herein from each other embodiment of the invention disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A crutch configured to provide energy storage and return to a user during ambulation, the crutch comprising:

an elongate member comprising:

a proximal portion configured to support a forearm of a user, a central portion extending distally from and bent at a first angle relative to the proximal portion, and a curved distal portion extending distally from and bent at a second angle relative to the central portion, wherein at least a portion of the curved distal portion, at least a portion of the proximal portion, and at least a portion of the central portion are configured to flex and un-flex responsive a force applied by a user's weight during ambulation, wherein said flexion is configured to store energy in the crutch during ambulation, wherein said un-flexion is configured to release the stored energy in a direction that propels the user during ambulation.

2. The crutch of claim 1, wherein at least one of the first angle or the second angle comprises an obtuse angle.

3. The crutch of claim 1, wherein at least two of the proximal portion, the central portion, and the curved distal portion are made of a same material.

4. The crutch of claim 1, wherein the elongate member further comprises at least one of a rectangular, an oval, a teardrop, or a circular cross-sectional profile.

5. The crutch of claim 1, wherein the curved distal portion comprises a contact surface on which the crutch rolls over during ambulation.

6. The crutch of claim 1, wherein the elongate member further comprises a joint between at least one of the proximal portion and the central portion or the central portion and the curved distal portion.

7. The crutch of claim 1, wherein the central portion is monolithically formed with at least one of the proximal portion or the curved distal portion.

8. A crutch configured to provide energy storage and return to a user during ambulation, the crutch comprising:

an elongate member comprising:

a flexible proximal portion configured to support a forearm of a user, wherein the flexible proximal portion is configured to flex and un-flex responsive a force applied by a user's weight during ambulation, wherein said flexion is configured to store energy in the crutch during ambulation, wherein said un-flexion is configured to release the stored energy, a flexible central portion extending distally from the flexible proximal portion, wherein the flexible central portion is configured to flex and un-flex responsive a force applied by a user's weight during ambulation, wherein said flexion is configured to store energy in the crutch during ambulation, wherein said un-flexion is configured to release the stored energy, and a curved, flexible distal portion extending distally from the flexible central portion, wherein the curved, flexible distal portion comprises a contact surface on which the crutch rolls over during ambulation, wherein the curved, flexible distal portion is configured to flex and un-flex responsive a force applied by a user's weight during ambulation, wherein said flexion is configured to store energy in the crutch during ambulation, wherein said un-flexion is configured to release the stored energy.

9. The crutch of claim 8, wherein the flexible central portion is monolithically formed with at least one of the flexible proximal portion or the curved, flexible distal portion.

10. The crutch of claim 8, wherein the flexible central portion extends from the flexible proximal portion at an obtuse angle or an acute angle.

11. The crutch of claim 8, wherein the curved, flexible distal portion extends from the flexible central portion at an obtuse angle or an acute angle.

12. The crutch of claim 8, wherein the elongate member further comprises a joint between at least one of the flexible proximal portion and the flexible central portion or the flexible central portion and the curved, flexible distal portion.

13. The crutch of claim 8, wherein the elongate member further comprises one or more slits configured to effect a torsional movement of the crutch.

14. A crutch configured to provide energy storage and return to a user during ambulation, the crutch comprising:

an elongate member comprising a proximal portion configured to support a forearm of a user, a distal portion configured to contact a support surface during ambulation, and a central portion extending between the proximal portion and the distal portion, wherein at least a portion of the proximal portion, at least a portion of the central portion, and at least a portion of the distal portion are configured to flex and un-flex responsive a force applied by a user's weight during ambulation, wherein said flexion of the at least a portion of the proximal portion, the at least a portion of the central portion, and the at least a portion of the distal portion is configured to store energy in the crutch during ambulation, wherein said un-flexion of the at least a portion of the proximal portion, the at least a portion of the central portion, and the at least a portion of the distal portion is configured to release the stored energy in a direction that propels the user during ambulation; and a heel blade distally attached to the elongate member, wherein vertical forces generated at heel contact during ambulation are stored and returned to the user by the heel blade.

15. The crutch of claim 14, wherein the central portion extends from the proximal portion at an obtuse angle or an acute angle, wherein the distal portion extends from the central portion at an obtuse angle or an acute angle.

16. The crutch of claim 14, wherein the elongate member further comprises one or more slits configured to effect a torsional movement of the crutch.

17. The crutch of claim 14, further comprising a blade member proximate to the distal portion, wherein the blade member is configured to contact an upper surface of the distal portion during ambulation to effect an increase in a stiffness of the crutch, wherein the increase in the stiffness of the crutch is based at least in part on a level of load applied by the user to the crutch during ambulation.

18. The crutch of claim 14, further comprising an arm cuff attached to the proximal portion of the elongate member, wherein the arm cuff is configured to receive an arm of the user, wherein the arm cuff comprises a hinge, wherein the hinge is configured to allow a portion of the arm cuff to pivot relative to the proximal portion of the elongate member.

19. The crutch of claim 14, further comprising a wrist support member configured to extend over a palmar side of a wrist or the forearm of the user.

20. The crutch of claim 14, wherein at least a portion of the elongate member is hollow.

* * * * *